US010675875B2

(12) United States Patent
Nagashima et al.

(10) Patent No.: US 10,675,875 B2
(45) Date of Patent: Jun. 9, 2020

(54) LIQUID CONTAINER

(71) Applicant: SEIKO EPSON CORPORATION, Tokyo (JP)

(72) Inventors: Takumi Nagashima, Matsumoto (JP); Hiroyuki Kawate, Hokuto (JP); Hiroyushi Ozeki, Shiojiri (JP); Manabu Yamaguchi, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/223,672

(22) Filed: Dec. 18, 2018

(65) Prior Publication Data

US 2019/0184710 A1 Jun. 20, 2019

(30) Foreign Application Priority Data

Dec. 19, 2017 (JP) ..... 2017-242667

(51) Int. Cl.
*B41J 2/175* (2006.01)
*B41J 29/13* (2006.01)

(52) U.S. Cl.
CPC ..... *B41J 2/17513* (2013.01); *B41J 2/175* (2013.01); *B41J 2/1752* (2013.01); *B41J 2/1753* (2013.01); *B41J 2/17523* (2013.01); *B41J 2/17553* (2013.01); *B41J 2/17556* (2013.01); *B41J 29/13* (2013.01); *B41J 2002/17516* (2013.01)

(58) Field of Classification Search
CPC ..... B41J 2/17513; B41J 2/1752; B41J 2/175; B41J 2/1753; B41J 29/13; B41J 2/17523; B41J 2/17556; B41J 2/17553; B41J 2002/17516
See application file for complete search history.

(56) References Cited

U.S. PATENT DOCUMENTS

| | | | | |
|---|---|---|---|---|
| 2007/0046743 | A1 | 3/2007 | Wakayama | |
| 2009/0015642 | A1 | 1/2009 | Nozawa et al. | |
| 2013/0222491 | A1* | 8/2013 | Nanjo | B41J 2/17509 347/86 |
| 2017/0173966 | A1* | 6/2017 | Kawate | B41J 2/17513 |
| 2018/0104955 | A1 | 4/2018 | Kawate et al. | |

FOREIGN PATENT DOCUMENTS

| | | | |
|---|---|---|---|
| JP | 2008-087486 | A | 4/2008 |
| JP | 2009-034989 | A | 2/2009 |
| JP | 4519070 | B2 | 8/2010 |
| JP | 2015-168247 | A | 9/2015 |
| JP | 2018-065373 | A | 4/2018 |

* cited by examiner

*Primary Examiner* — Justin Seo
(74) *Attorney, Agent, or Firm* — Foley & Lardner LLP

(57) ABSTRACT

Liquid and sedimentary components are kept from remaining in a bag of a liquid container. The liquid container includes a flexible bag in which a liquid storage portion for containing a liquid is provided, a liquid outlet member that is attached to one edge portion of the bag, and has a liquid outlet portion for leading out the liquid to a liquid ejection apparatus, a spacer member arranged in the liquid storage portion, and a liquid outlet tube that constitutes a flow path of liquid extending in the liquid storage portion from the liquid outlet member toward the spacer member. The spacer member is arranged at a position separated from an end portion of the liquid storage portion, and at least one directing channel extending from the end portion side of the liquid storage portion in a direction approaching the spacer member is formed in the liquid storage portion.

13 Claims, 19 Drawing Sheets

LIQUID CONTAINER

BACKGROUND

1. Technical Field

The present invention relates to a liquid container.

2. Related Art

Heretofore, liquid storage bodies for supplying liquid to a liquid ejection apparatus have been widely used. For example, liquid storage bodies disclosed in JP-A-2009-34989, Japanese Patent No. 4519070, JP-A-2015-168247 and JP-A-2008-87486 have a flexible bag, which contains a liquid to be supplied to a liquid ejection apparatus.

JP-A-2009-34989, Japanese Patent No. 4519070, JP-A-2015-168247 and JP-A-2008-87486 are examples of related art.

The flexible bag shrinks as the liquid is consumed. However, depending on the position at which the shrinkage occurs and the state of the shrinkage, there is a possibility that a channel in the bag is blocked, and liquid cannot be sufficiently supplied to the liquid ejection apparatus. In addition, sedimentary components contained in the liquid are likely to retain. Therefore, at an initial state of liquid consumption, the liquid that contains a small amount of sedimentary components with a low concentration is discharged, and as the liquid is further consumed, the rate of the sedimentary components that retain in the bag increases, thereby the concentration increases, and there has been a risk that the concentration of the sedimentary components in the liquid that is supplied to the liquid ejection apparatus becomes uneven. In addition, there has been a possibility that sedimentary components are more likely to retain in a section in which a channel in the bag is blocked, or flow of liquid in the bag discontinues. In particular, in a section that is far from a liquid supply port that is connected to the liquid ejection apparatus, there is a tendency that a channel is likely to be blocked and flow of liquid is likely to stop, and there is a tendency that liquid and sedimentary components are likely to retain. Such tendencies exist regardless of the volume of the bag, and, in particular, there has been a possibility that such tendencies are significant if the volume of the bag is large.

SUMMARY

The invention has been made to solve at least some of the above-described issues, and can be realized as the following modes.

(1) One mode is provided as a liquid container for supplying a liquid containing a sedimentary component to a liquid ejection apparatus. The liquid container of this mode includes a flexible bag in which a liquid storage portion for containing the liquid is provided, and that has one edge portion and the other edge portion opposing the one edge portion; a liquid outlet member that is attached to the one edge portion, and has a liquid outlet portion for leading out the liquid in the liquid storage portion to the liquid ejection apparatus; a spacer member arranged in the liquid storage portion; and a liquid outlet tube that constitutes a flow path of the liquid that extends in the liquid storage portion from the liquid outlet member toward the spacer member. When three directions orthogonal to each other are defined as a D direction, a T direction, and a W direction, the D direction being defined as a direction along a direction from the one edge portion side of the bag toward the other edge portion side, where a direction from the one edge portion side toward the other edge portion side is defined as a +D direction and an opposite direction to the +D direction is defined as a −D direction, and the T direction being defined as a direction in which a dimension of an outer shape of the liquid container is smallest among the three directions, the spacer member is arranged at a position separated from edge portions of the liquid storage portion in the W direction and in the D direction, and at least one directing channel that extends along a DW plane that includes the D direction and the W direction, from an edge portion side of the liquid storage portion in a direction approaching the spacer member, and directs the liquid toward the spacer member is formed in the liquid storage portion.

According to the liquid container of this mode, a channel of liquid is secured due to a space in the periphery of the liquid outlet tube provided in the liquid storage portion, and the channel in the bag is unlikely to be blocked. In addition, the liquid outlet tube extends from the liquid outlet member toward the spacer member, and the spacer member is positioned on the farther side (the +D direction side) relative to the end portion on the +D direction side of the liquid outlet tube. Therefore, the end portion on the +D direction side of the liquid outlet tube and also a channel on the farther side of the end portion on the +D direction side are unlikely to be blocked. Moreover, liquid at a position separated from the spacer member can be guided toward the spacer member and be directed to the liquid outlet tube, using at least one directing channel that extends from an edge portion side of the liquid storage portion in a direction approaching the spacer member, and directs liquid toward the spacer member. Therefore, it is possible to suppress inhibition of flow of liquid in the bag, and liquid and sedimentary components can be kept from remaining in the liquid container. In particular, disruption of flow of liquid at a position separated from the spacer member is suppressed due to the directing channel, and thus it is possible to smoothly direct sedimentary components as well as liquid toward the liquid outlet tube, and sedimentary components are kept from remaining. Therefore, according to the liquid container of this mode, it is possible to sufficiently supply liquid to the liquid ejection apparatus. In addition, it is possible to improve the evenness of the concentration of liquid that is supplied to liquid ejection apparatus.

[2] In the liquid container of above-described mode, the at least one directing channel may include a channel extending from the +D direction side of the spacer member in a direction approaching the spacer member.

According to the liquid container of this mode, it is possible to suppress blockage of a channel in on the +D direction side relative to the spacer member. In addition, it is possible to keep liquid and sedimentary components from remaining on the +D direction side of the spacer member.

[3] In the liquid container of above-described mode, the at least one directing channel may include a channel extending from the +D direction side of the spacer member and one direction side out of directions along the W direction, in a direction approaching the spacer member.

According to the liquid container of this mode, it is possible to suppress blockage of a channel in a region on the +D direction side of the spacer member and on one direction side out of the directions in the W direction. In addition, it is possible to keep liquid and sedimentary components from remaining in the region on the +D direction side of the spacer member and on one direction side out of the directions in the W direction.

[4] In the liquid container of above-described mode, the at least one directing channel may include a channel extending from the −D direction side of the spacer member and one direction side out of directions along the W direction, in a direction approaching the spacer member.

According to the liquid container of this mode, it is possible to suppress blockage of a channel in a region on the −D direction side of the spacer member and on one direction side out of the directions in the W direction. In addition, it is possible to keep liquid and sedimentary components from remaining in the region on the −D direction side of the spacer member and on one direction side out of the directions in the W direction.

[5] In the liquid container of above-described mode, when one direction in the W direction is defined as a +W direction, and a direction opposite to the +W direction is defined as a −W direction, the at least one directing channel may include a first inclined channel extending from the +D direction side and the +W direction side of the spacer member in a direction approaching the spacer member and a second inclined channel extending from the +D direction side and the −W direction side of the spacer member in a direction approaching the spacer member.

According to the liquid container of this mode, using the first inclined channel and the second inclined channel, it is possible to suppress blockage of channels in a region on the +W direction side and a region on the −W direction side in a region on the +D direction side of the spacer member. In addition, it is possible keep liquid and sedimentary components from remaining in the region on the +W direction side and the region on the −W direction side in the region on the +D direction side of the spacer member.

[6] In the liquid container of above-described mode, the at least one directing channel may further include a central channel that is positioned between the first inclined channel and the second inclined channel in the W direction, and extends from the +D direction side of the spacer member in a direction approaching the spacer member.

According to the liquid container of this mode, it is possible to suppress blockage of a channel in a region between the first inclined channel and the second inclined channel. In addition, it is possible to keep liquid and sedimentary components from remaining in the region between the first inclined channel and the second inclined channel.

[7] In the liquid container of above-described mode, the at least one directing channel may further include a third inclined channel extending from the −D direction side and the +W direction side of the spacer member in a direction approaching the spacer member and a fourth inclined channel extending from the −D direction side and the −W direction side of the spacer member in a direction approaching the spacer member.

According to the liquid container of this mode, it is possible to suppress blockage of a channel not only in a region on the +D direction side relative to the spacer member but also a region on the −D direction side relative to the spacer member. In addition, it is possible to keep liquid and sedimentary components from remaining in a region on the −D direction side relative to the spacer member.

[8] In the liquid container of the above-described mode, the spacer member may have an inclined face that is inclined relative to the D direction such that a dimension along the T direction increases toward the −D direction side from the +D direction side.

According to the liquid container of this mode, when the bag shrinks as liquid is consumed, the bag is likely to gradually collapse along the inclined face of the spacer member from the +D direction side to the −D direction side. Thus, it is possible to more effectively suppress blockage of a channel on the farther side (the +D direction side) of the spacer member.

[9] In the liquid container of above-described mode, the liquid outlet tube may be configured to, in an orientation in which the liquid container is mounted in the liquid ejection apparatus, extend from the liquid outlet portion in the liquid storage portion in a horizontal direction, the liquid outlet tube may have a first conduit portion and a second conduit portion, the first conduit portion may have a first base end portion that is connected to the liquid outlet member and a first leading end portion for introducing the liquid in the liquid storage portion into the first conduit portion, the second conduit portion may have a second base end portion that is connected to the liquid outlet member and a second leading end portion for introducing the liquid in the liquid storage portion into the second conduit portion, and, in the orientation, the first leading end portion may be positioned above the second leading end portion.

According to the liquid container of this mode, after introducing liquid on the upper side with a lower concentration due to sedimentary components having sunken, into the first conduit portion, introducing liquid on the lower side with a higher concentration, into the second conduit portion, and mixing the two types of liquid in the liquid outlet member, the liquid can be supplied to the liquid ejection apparatus. Accordingly, unevenness of the concentration of liquid that is supplied to the liquid ejection apparatus is further suppressed.

(10) In the liquid container of the above-described mode, the first leading end portion and the second leading end portion may be connected to the spacer member.

According to the liquid container of this mode, deviation of the first leading end portion and the second leading end portion, which serve as inlets for taking in liquid into the liquid storage portion, is suppressed. In addition, even if an impact is applied to the liquid container when the liquid container is carried and dropped or the like, the leading end portions of the liquid outlet tubes are prevented from being easily blocked due to the liquid outlet tube and the spacer member being separated from each other.

(11) When the liquid container of the above-described mode is in the orientation, the first base end portion and the second base end portion may be aligned in a horizontal direction, and the first leading end portion and the second leading end portion may be aligned in a vertical direction.

According to the liquid container of this mode, since the first leading end portion and the second leading end portion are fixed in the state of being aligned in the vertical direction, movement in the W direction is suppressed, and liquid can be suctioned at a stable position. In addition, increase in the width in the W direction of a region in which a liquid introduction tube is arranged is suppressed. According to the liquid container of this mode, two types of liquid that are introduced from the first leading end portion and the second leading end portion aligned in the vertical direction, and have different concentrations flow out from the first base end portion and the second base end portion aligned in the horizontal direction, and are mixed with each other. Therefore, unevenness of the concentration of liquid that is supplied to the liquid ejection apparatus is suppressed.

(12) In the liquid container of the above-described mode, the spacer member may be fixed to the liquid outlet member.

According to the liquid container of this mode, the positional relationship between the spacer member and the liquid outlet member can be stabilized. Thus, change of the position at which the spacer member is arranged is suppressed for each liquid container, and change of performance of supplying liquid to the liquid ejection apparatus is suppressed for each liquid container.

(13) In the liquid container of the above-described mode, the spacer member may be fixed to the liquid outlet member via a bar-like coupling member.

According to the liquid container of this mode, the positional relationship between the spacer member and the liquid outlet member can be further stabilized.

All of a plurality of constituent elements of each of the modes of the above-described invention are not necessary, and in order to solve a portion or the entirety of the above-described issues, or in order to achieve a portion or the entirety of effects described in the present specification, some of the constituent elements can be appropriately changed, deleted, and replaced with new other constituent elements, and a portion of a limitation content thereof can be deleted. In addition, in order to solve a portion or the entirety of the above-described issues, or in order to achieve a portion of or the entirety of the effects described in the present specification, one independent mode of the invention can be formed by combining a portion or the entirety of technical features included in one mode of the above invention and a portion or the entirety of technical features included in another mode of the above invention.

The invention can also be achieved in various modes other than as the liquid container. The invention can be realized in modes such as a liquid ejection apparatus that has a liquid container, a system that has a liquid container and a liquid ejection apparatus, a method for manufacturing a liquid container, a bag used for a liquid container, and a liquid output channel structure in a liquid container.

DESCRIPTION OF EXEMPLARY EMBODIMENTS

1. First Embodiment

Figure 1:
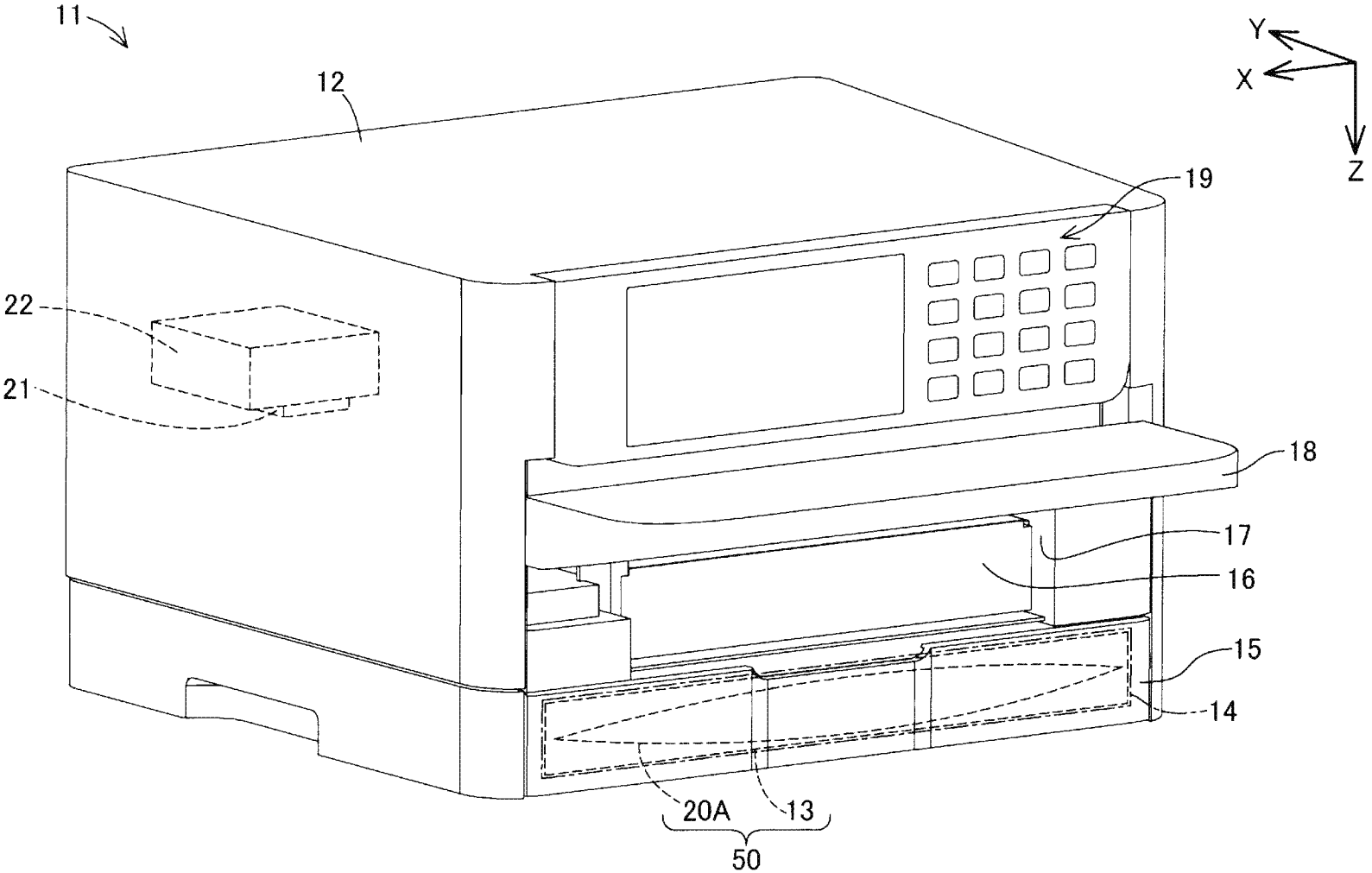
FIG. 1 is a schematic perspective view of a liquid ejection apparatus.

FIG. 1 is a schematic perspective view of a liquid ejection apparatus 11 in which a liquid container 20A in a first embodiment is stored. In FIG. 1, an X axis, a Y axis, and a Z axis indicating three directions orthogonal to each other are illustrated. The X axis and the Y axis indicate directions parallel to a horizontal plane. The X axis is parallel to the width direction of the liquid ejection apparatus 11 in a normal usage orientation in which the liquid ejection apparatus 11 is arranged on a horizontal plane, and indicates a direction from the right to the left when opposed to the front face of the liquid ejection apparatus 11 (to be described later). The Y axis is parallel to the front-rear direction of the liquid ejection apparatus 11 in the normal usage orientation, and indicates a direction from the front face toward the rear face of the liquid ejection apparatus 11. In the present specification, the Y axis direction may be referred to as "depth direction". The Z axis is parallel to the height direction of the liquid ejection apparatus 11, and indicates a gravity direction. Also in FIGS. 2 to 4 to be referred to later, the X axis, the Y axis, and the Z axis are illustrated in correspondence with those in FIG. 1.

In the first embodiment, the liquid ejection apparatus 11 is an inkjet printer that performs recording (printing) by ejecting ink, which is an example of a liquid, onto a medium such as paper. The liquid ejection apparatus 11 is provided with an exterior body 12 having a substantially rectangular parallelepiped shape. In the liquid ejection apparatus 11, a face of the exterior body 12 that includes height and width, and to which the user is envisioned to be opposed when operating the liquid ejection apparatus 11 is referred to as "front face".

In a front face portion of the exterior body 12, a rotatable front lid 15 that covers a mount portion 14 in which a container 13 is detachably mounted and a mount port 17 in which a cassette 16 that can store a medium (not illustrated) is mounted are provided in the stated order upward from the bottom side. In FIG. 1, the position of the mount portion 14 is schematically indicated by alternate long and short dash lines. The configuration of the mount portion 14 will be described later. A discharge tray 18 that receives a medium that is being discharged and an operation panel 19 for the user to operate the liquid ejection apparatus 11 are arranged above the mount port 17.

In the mount portion 14 of this embodiment, the container 13 (illustrated in broken lines) is mounted. The container 13 is inserted into the mount portion 14 from the front face side, and is detachably mounted to the liquid ejection apparatus 11. The movement direction when the container 13 is mounted to the mount portion 14 (hereinafter, also referred to as "mounting direction") is the Y axis direction.

The liquid container 20A (illustrated in broken lines) that contains liquid to be supplied to the liquid ejection apparatus 11 is removably placed on the container 13. Hereinafter, the container 13 on which the liquid container 20A is arranged is also referred to as "mount body 50". In addition, an orientation of the liquid container 20A in which the liquid container 20A placed on the container 13 is mounted in the liquid ejection apparatus 11 is referred to as "mounted orientation". The configurations of the container 13 and the liquid container 20A will be described later. Note that the container 13 can be detachably mounted to the mount portion 14 even in a state in which the liquid container 20A is not mounted, and is a constituent element that is mounted in the liquid ejection apparatus 11.

A liquid ejection unit 21 that ejects a liquid from a nozzle and a carriage 22 that moves reciprocally along a scanning direction that coincides with the width direction (the X axis direction) of the liquid ejection apparatus 11 are provided in the exterior body 12. The liquid ejection unit 21 moves along with the carriage 22. The liquid ejection unit 21 ejects liquid supplied from the liquid container 20A placed on the container 13, onto a medium that is being conveyed in a sub-scanning direction along the Y axis direction, below the movement path of the carriage 22.

Note that in another embodiment, the liquid ejection unit 21 may be a line head whose position is fixed, and that does not move reciprocally.

Figure 2:
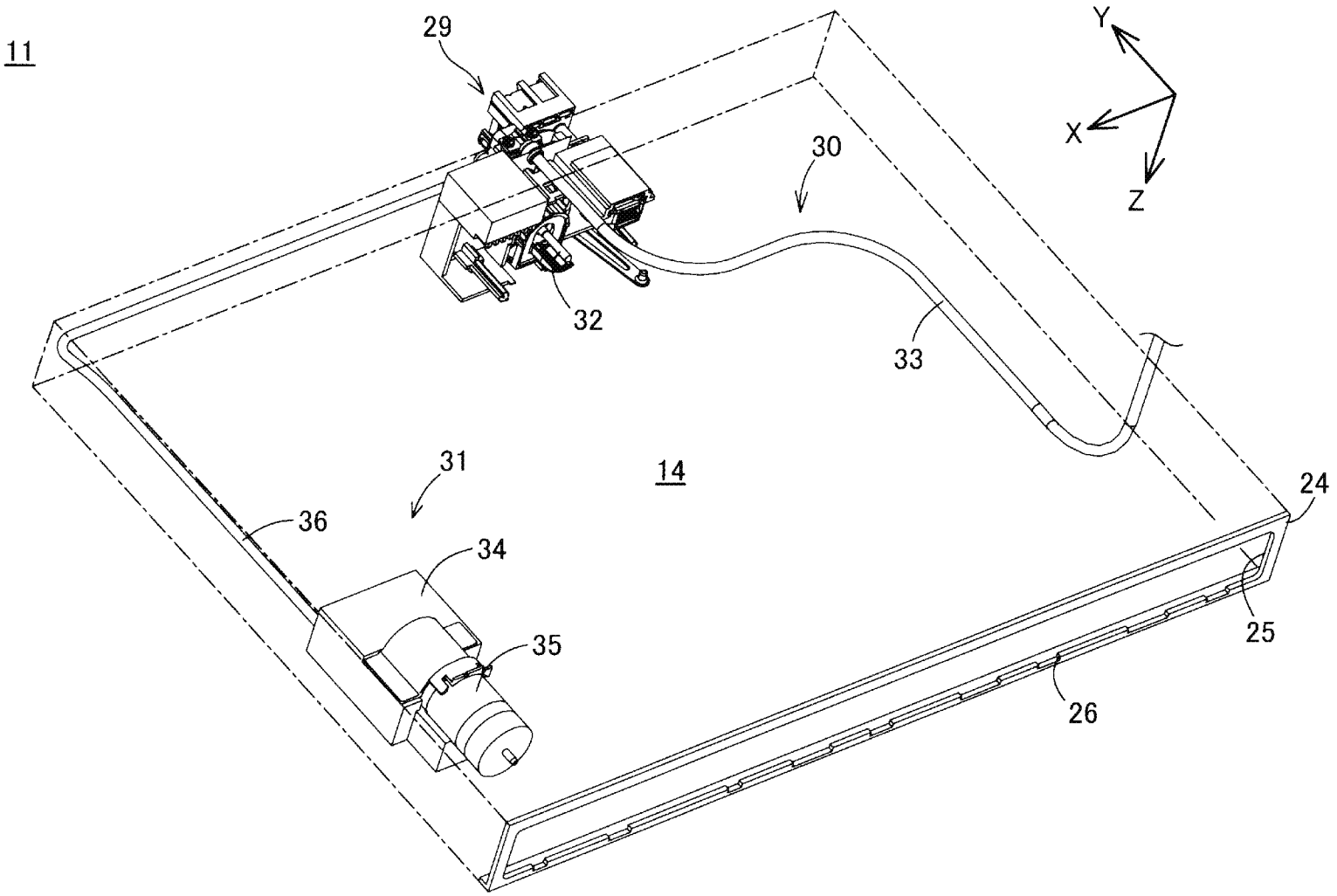
FIG. 2 is a schematic perspective view showing the configuration of a mount portion.

FIG. 2 is a schematic perspective view showing the configuration of the mount portion 14. In the liquid ejection apparatus 11, the mount portion 14 is formed as a storage space in which one container 13 can be stored. A frame body 24 is attached to the entrance of the mount portion 14 behind the front lid 15 (see FIG. 1). The frame body 24 has an insertion port 25 that are in communication with the storage space from the front side, which is the front lid 15 side. On the inner peripheral face of the insertion port 25, the frame body 24 preferably has a plurality of pairs of linear guide rails 26 for guiding a mounting or removing movement of the container 13, the guide rails 26 extending in the depth direction and having one or more projecting shapes or recessed shapes.

The container 13 is inserted into the storage space through the insertion port 25. The container 13 is moved along the movement path that is provided on the bottom face of the mount portion 14, extends toward the back, and runs along the Y axis direction, and thereby is mounted to the mount portion 14. On the back side of the mount portion 14, a connection mechanisms 29 that is connected to the liquid container 20A placed on the container 13. The connection mechanism 29 has an introduction needle 32 for introducing liquid in the liquid container 20A to the connection mechanism 29, by being inserted into the liquid container 20A. The configuration of the connection mechanism 29 will be described below.

The liquid ejection apparatus 11 is provided with a supply channel 30 for supplying a liquid toward the liquid ejection unit 21 from the connection mechanism 29 to which the liquid container 20A is connected, and a supply mechanism 31 that generates driving force for sending liquid contained in the liquid container 20A to the supply channel 30. The supply channel 30 includes a flexible supply tube 33. The upstream end of the supply tube 33 is connected to the connection mechanism 29, and the downstream end of the supply tube 33 is connected to the liquid ejection unit 21 (illustrated in FIG. 1). A pump chamber (not illustrated) that is in communication with the downstream end of the introduction needle 32 and the upstream end of the supply tube 33 is provided inside the connection mechanism 29. The pump chamber is demarcated via a pressure change chamber and a flexible film, which are not illustrated.

The supply mechanism 31 is provided with a pressure change mechanism 34, a driving source 35 of the pressure change mechanism 34, and a pressure change channel 36 that connects the pressure change mechanism 34 and the above-described pressure change chamber. When the pressure change mechanism 34 depressurizes the pressure change chamber provided in the connection mechanism 29, through the pressure change channel 36 due to driving of the driving source 35 (e.g., a motor), the flexible film between the pump chamber and the pressure change chamber warps and shifts to the pressure change chamber side, and thus the pressure in the pump chamber decreases. Accompanied with this pressure decrease in the pump chamber, liquid contained in the liquid container 20A is suctioned to the pump chamber through the introduction needle 32. This is called suction driving.

Then, when the pressure change mechanism 34 releases the decompression in the pressure change chamber through the pressure change channel 36, the flexible film warps and shifts to the pump chamber side, and thus the pressure in the pump chamber increases. Accompanied with the increase in the pressure in the pump chamber, the liquid in the pump chamber then flows out to the supply tube 33 in a state of being pressurized. This is called discharge driving. The supply mechanism 31 supplies liquid from the liquid container 20A to the liquid ejection unit 21 by alternately repeating the suction driving and the discharge driving.

Figure 3:
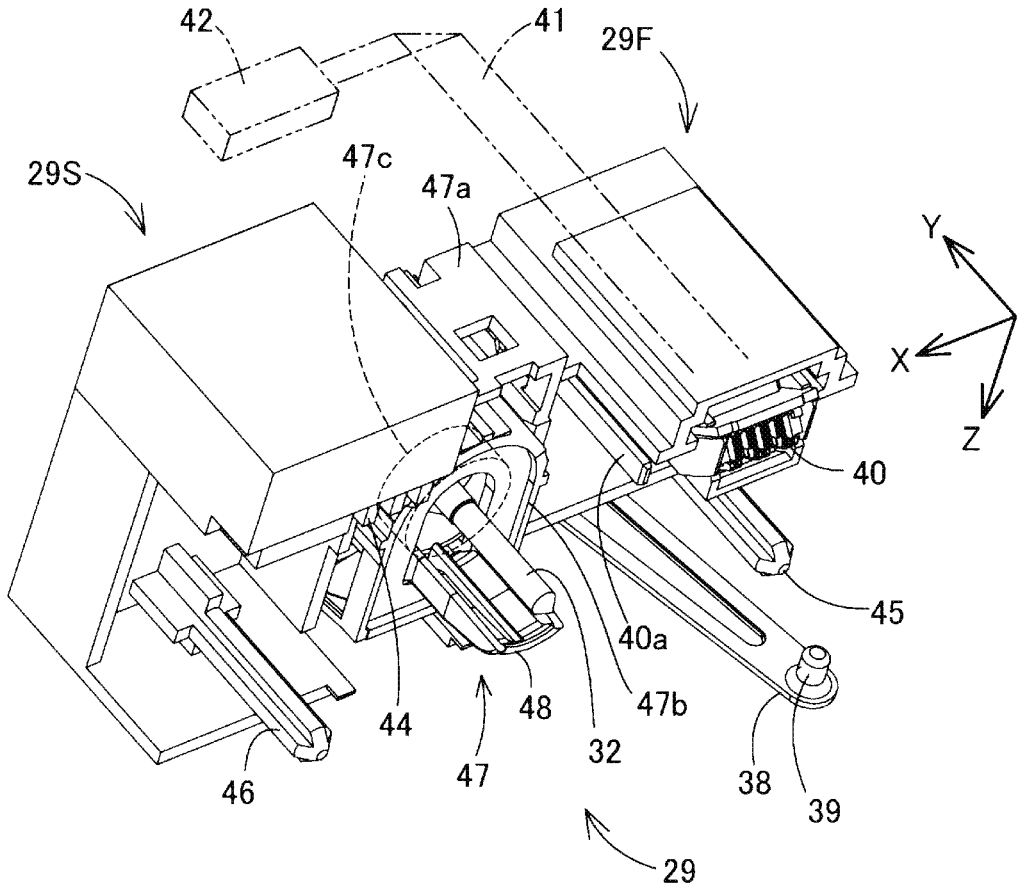
FIG. 3 is a schematic perspective view of a connection mechanism.

FIG. 3 is a schematic perspective view of the connection mechanism 29. The connection mechanism 29 has a first connection mechanism 29F and a second connection mechanism 29S respectively at positions sandwiching the introduction needle 32 in the width direction (the X axis direction). The first connection mechanism 29F has an arm 38. The arm 38 is arranged vertically lower than the introduction needle 32, and protrudes in the removal direction in which the mount body 50 is removed from the mount portion 14 (a direction opposite to the Y axis direction). The arm 38 is configured such that the leading end side thereof can be rotated about the base end side. An engaging portion 39 is provided at the leading end of the arm 38. The engaging portion 39 protrudes from the arm 38 vertically upward, for example, and is arranged on the movement path of the container 13 when the container 13 is mounted to the mount portion 14 (see FIG. 2). The engaging portion 39 is fitted in an engagement groove 78 (illustrated in FIG. 4 to be referred to later) provided in the rear face of the container 13 when the container 13 is mounted to the mount portion 14, thereby restricting easy detachment of the container 13 from the mount portion 14.

The first connection mechanism 29F is provided with a terminal portion 40 that is arranged above the introduction needle 32 vertically, and protrudes in the removal direction. The terminal portion 40 is connected to a control apparatus 42 that controls supply of liquid in the liquid ejection apparatus 11, via an electric line 41 such as a flat cable. The terminal portion 40 is preferably arranged such that the upper end of the terminal portion 40 protrudes past the lower end in the removal direction, and is directed obliquely downward. A pair of guiding projections 40*a* that protrude in the width direction, and extend along the mounting direction are preferably arranged on the two sides in the width direction of the terminal portion 40.

The second connection mechanism 29S is arranged above the introduction needle 32 vertically. The second connection mechanism 29S has blocks 44 for preventing erroneous insertion, which protrude in the removal direction. The blocks 44 have a recession-and-protrusion-shape arranged to face downward.

The connection mechanism 29 is provided with a pair of positioning protrusions 45 and 46, an extrusion mechanism 47 arranged so as to surround the introduction needle 32, and a liquid receiving portion 48 protruding in the removal direction below the introduction needle 32. The pair of positioning protrusions 45 and 46 are aligned in the width direction sandwiching the introduction needle 32 so as to be respectively included in the first connection mechanism 29F and the second connection mechanism 29S. The positioning protrusions 45 and 46 can be bar-like protrusions protruding in the removal direction in parallel to each other, for example. The protrusion length in the removal direction of the positioning protrusions 45 and 46 is preferably set to be longer than the protrusion length in the removal direction of the introduction needle 32.

The extrusion mechanism 47 has a frame member 47*a* surrounding the base end portion of the introduction needle 32, a pressing portion 47*b* protruding from the frame member 47*a* in the removal direction, and a biasing portion 47*c* that biases the container 13 in the removal direction via the pressing portion 47*b*. The biasing portion 47*c* is constituted by a coil spring installed between the frame member 47*a* and the pressing portion 47*b*, for example. The extrusion mechanism 47 applies biasing force to the mount body 50 mounted in the mount portion 14 in the removal direction (see FIG. 2). Note that, in the state of being mounted in the mount portion 14, the mount body 50 (illustrated in FIG. 4 to be referred to later) is engaged with the engaging portion 39, and thus movement of the mount body 50 in the removal direction is restricted.

Figure 4:
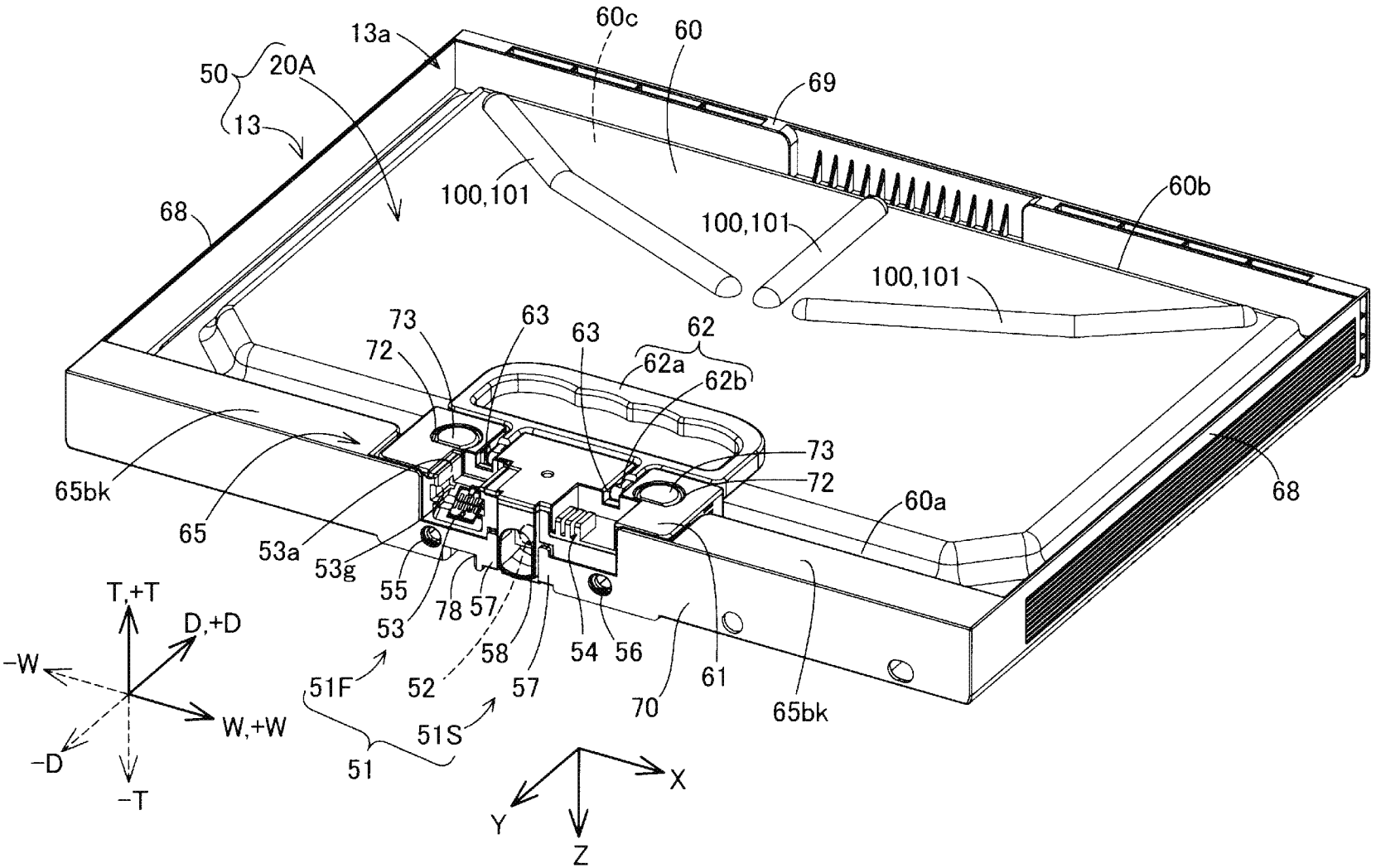
FIG. 4 is a schematic perspective view of a mount body.

FIG. 4 is a schematic perspective view showing the configuration of the mount body 50 that is mounted in the mount portion 14. FIG. 4 shows arrows indicating three directions orthogonal to each other, namely a D direction, a T direction, and a W direction. In the mounted orientation in which the mount body 50 is mounted in the liquid ejection apparatus 11 in the normal usage orientation, the D direction, the T direction, and the W direction correspond to the X axis, the Y axis, and the Z axis described with reference to FIG. 1, as follows.

The D direction is a direction along the Y axis, and an arrow indicating the D direction indicates a direction opposite to the Y axis direction. The T direction is a direction along the Z axis, and an arrow indicating the T direction indicates a direction opposite to the Z axis direction. The W direction is a direction along the X axis, and an arrow indicating the W direction indicates the same direction as the X axis direction. In the following description, positive directions of the D direction, the T direction, and the W direction indicated by the arrows of the D direction, the T direction, and the W direction are also respectively referred to as a +D direction, a +T direction, and a +W direction. In addition, the opposite directions (negative directions) of the D direction, the T direction, and the W direction are also respectively referred to as a −D direction, a −T direction, and a −W direction. Also in the figures to be referred to later, the arrows indicating the D direction, the T direction, and the W direction are illustrated as appropriate in correspondence with those in FIG. 4. Note that, in the figures other than FIG. 4, arrows indicating the −D direction, the −T direction, and the −W direction are not illustrated. In the following description, the D direction, the T direction, and the W direction refer to directions when the liquid container 20A is in the mounted orientation unless specifically stated otherwise.

The mount body 50 is configured by the liquid container 20A being placed on the container 13. Regarding the container 13 and the liquid container 20A that constitute the mount body 50, the T direction from among three direction, namely the D direction, the T direction, and the W direction is a direction in which the dimension of the outer shape is smallest. In addition, in this embodiment, the dimensions of the outer shapes of the container 13 and the liquid container 20A in the W direction are larger than the dimensions of the outer shapes in the D direction. Note that, in another embodiment, the dimensions of the outer shapes in the W direction may be smaller than the dimensions of the outer shapes in the D direction.

The end on the −D direction side of the mount body 50 that comes front when the mount body 50 is mounted to the mount portion 14 (see FIG. 2) is assumed to be a leading end, and an end that is on the +D direction side and is opposite to the leading end is assumed to be a base end. The mount body 50 has a connection structure 51 at its leading end portion. The connection structure 51 has a liquid outlet portion 52 at the center in the width direction (the W direction) of the connection structure 51. The liquid outlet portion 52 is a supply port into which the introduction needle 32 of the connection mechanism 29 (see FIG. 3) is inserted in the +D direction, and that is for leading out liquid to be supplied to the liquid ejection apparatus 11. FIG. 4 illustrates the position of the liquid outlet portion 52 in a broken line. The connection structure 51 has a first connection structure 51F and a second connection structure 51S respectively on the two sides in the width direction of the connection structure 51 sandwiching the liquid outlet portion 52.

The first connection structure 51F is provided with a connection terminal 53 that is connected electrically to the terminal portion 40 of the connection mechanism 29 (see FIG. 3). For example, the connection terminal 53 is provided on the surface of a circuit substrate. The circuit substrate includes a storage unit that stores various types of information regarding the liquid container 20A (e.g., the type of the liquid container 20A and the liquid containing capacity).

The connection terminal 53 is preferably provided at a position higher than the liquid outlet portion 52. In addition, the connection terminal 53 is preferably arranged to be directed obliquely upward, in a recessed portion 53*a* that is open upward and in the mounting direction. It is preferred that, on the two sides in the width direction of the connection terminal 53, a recessed guiding portion 53*g* that extends in the mounting direction, and into which a pair of guiding projections 40*a* (see FIG. 3) are inserted is provided.

The second connection structure 51S is provided with an identification portion 54 for preventing erroneous insertion, which is arranged in the vertically upward direction relative to the liquid outlet portion 52. The identification portion 54 has a recession-and-protrusion pattern shaped to fit the corresponding blocks 44 (see FIG. 3) of the connection mechanism 29.

The connection structure 51 is provided with a pair of positioning holes 55 and 56 and a bias receiving portion 57. The pair of positioning holes 55 and 56 function as positioning portions when the mount body 50 is mounted to the mount portion 14. The pair of positioning holes 55 and 56 are aligned in the width direction sandwiching the liquid outlet portion 52. The first positioning hole 55 is included in the first connection structure 51F, and the second positioning hole 56 is included in the second connection structure 51S. The first positioning hole 55 and the second positioning hole 56 preferably have different opening shapes. In this embodiment, the first positioning hole 55 is configured as a circular hole, and the second positioning hole 56 is configured as a substantially elliptical elongated hole that is longer in the width direction.

In the mounted orientation, the bias receiving portion 57 abuts against the extrusion mechanism 47 of the connection mechanism 29 (see FIG. 3), and receives biasing force from a biasing portion 47*c*.

Connection of the connection structure 51 provided in the mount body 50 to the connection mechanism 29 will be described with reference to FIGS. 3 and 4. When the mount body 50 is inserted into the mount portion 14, and the leading end approaches the connection mechanism 29, the leading ends of the positioning protrusions 45 and 46 whose protrusion length in the removal direction is long are first inserted into the positioning holes 55 and 56 of the mount body 50, and movement of the mount body 50 in the width direction is restricted. In this embodiment, as described above, the second positioning hole 56 is an elliptical long hole extending in the width direction, and play for slightly allowing movement in the width direction of the second positioning protrusion 46 is provided. On the other hand, the first positioning protrusion 45 is inserted into the first positioning hole 55 having a circular shape in a state where there is substantially no gap. Therefore, virtually, the first positioning protrusion 45 and the first positioning hole 55 serve as references for positioning.

In this embodiment, a configuration is adopted in which connection of the introduction needle 32 to the liquid container 20A is complete after the mount body 50 is positioned using the positioning protrusions 45 and 46. After the positioning protrusions 45 and 46 are engaged with the positioning holes 55 and 56, and the mount body 50 further moves farther, the bias receiving portion 57 comes into contact with the pressing portion 47*b*, and receives biasing force of the biasing portion 47*c*. The introduction needle 32 is then inserted into the liquid outlet portion 52, and the introduction needle 32 and the liquid container 20A of the mount body 50 are connected.

When the mount body 50 moves in the mounting direction, the terminal portion 40 enters the recessed portion 53*a* of the mount body 50, and the recessed guiding portion 53*g* is guided to the guiding projection 40*a*. The position of the connection terminal 53 relative to the terminal portion 40 is thereby adjusted, and the terminal portion 40 comes into contact with the connection terminal 53. Accordingly, the connection terminal 53 and the terminal portion 40 are connected electrically, and communication of information between the circuit substrate and the control apparatus 42 becomes possible. As described above, the first positioning hole 55 serves as a reference for positioning of the mount body 50 relative to the connection mechanism 29. Therefore, in order to realize an excellent connection state between the connection terminal 53 and the terminal portion 40, the first positioning hole 55 is preferably provided in the first connection structure 51F that includes the connection terminal 53.

In the case where the mount body 50 is inserted at a proper position, the identification portion 54 is appropriately fitted to the blocks 44 of the connection mechanism 29. "Being fitted to" refers to a state where target objects are fitted to each other so as to restrict relative movement of the target objects. Conversely, in the case where the mount body 50 is to be mounted at an improper position, the identification portion 54 is not fitted to the blocks 44, and thus the mount body 50 cannot move any farther than that, preventing erroneous mounting. As described above, when the introduction needle 32 is connected to the liquid outlet portion 52 of the liquid container 20A, and the connection terminal 53 is connected electrically to the terminal portion 40, connection of the connection structure 51 to the connection mechanism 29 is complete.

Figure 5:
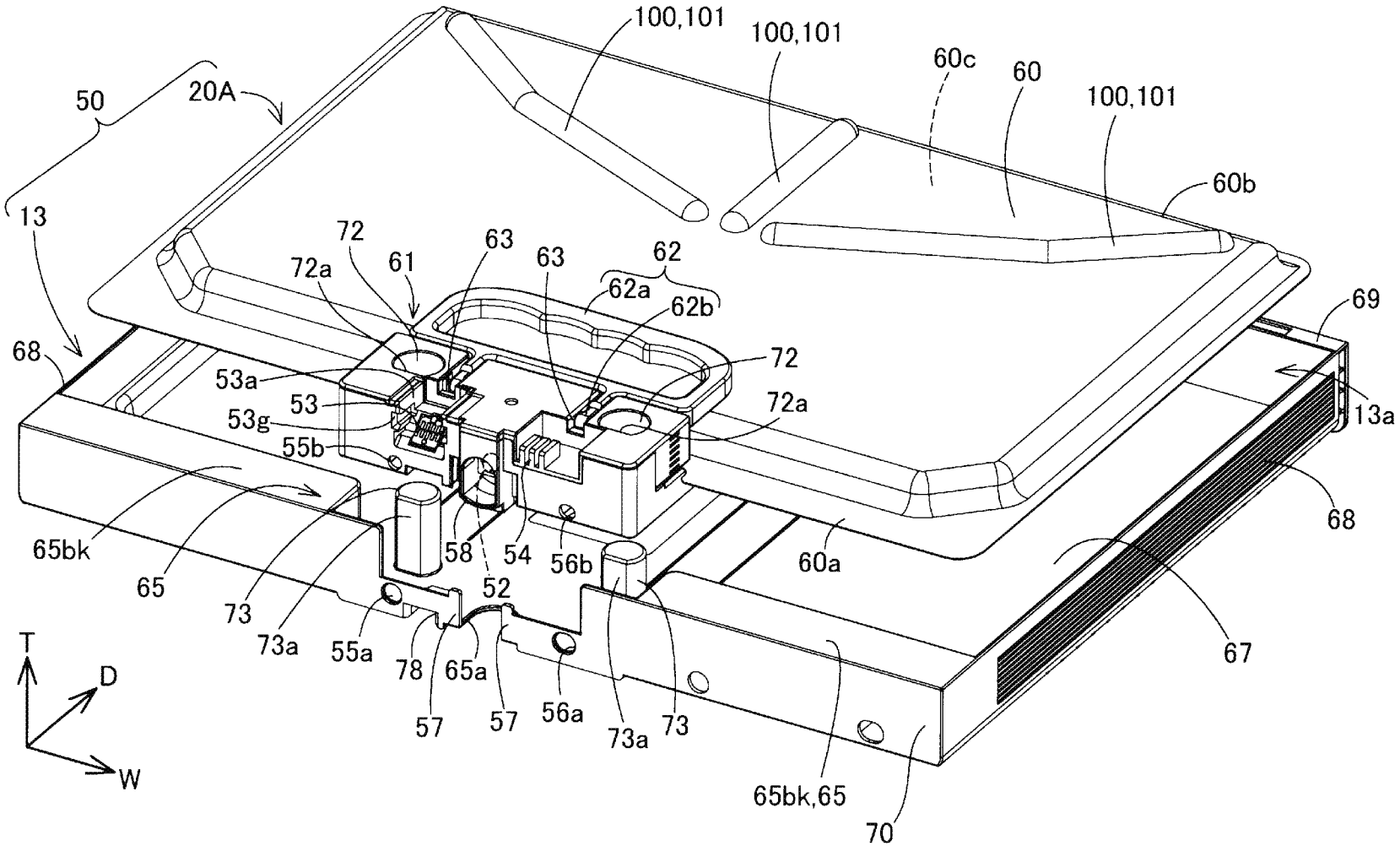
FIG. 5 is a schematic perspective exploded view of the mount body.

FIG. 5 is a schematic perspective exploded view of the mount body 50, and shows a state where the liquid container 20A is removed upward from the container 13. The container 13 is configured as a box that has a flat and substantially parallelepiped outer shape whose dimensions in the width direction and the depth direction are larger than the dimension in the height direction. The container 13 has a bottom wall 67 that constitutes the bottom face, a pair of side walls 68 provided in the periphery of the bottom wall 67, a front face wall 69, and a leading end wall 70. The pair of side walls 68 are provided so as to erect from the two ends in the width direction of the bottom wall 67 in the vertical upward direction. The front face wall 69 is provided so as to erect from the base end of the bottom wall 67 in the vertically upward direction. The leading end wall 70 is provided so as to erect from the leading end of the bottom wall 67 in the vertically upward direction.

A space inside the container 13 surrounded by the bottom wall 67, the pair of side walls 68, the front face wall 69, and the leading end wall 70 constitute a storing space for storing the liquid container 20A. The liquid container 20A is put into and taken out of the storing space of the container 13 through an opening 13*a* surrounded by the pair of side walls 68, the front face wall 69, and the leading end wall 70. The leading end wall 70 has a shape in which a central portion in the width direction thereof is notched, such that a portion of an adapter 61 (to be described later) of the liquid container 20A is exposed when the liquid container 20A is mounted in the container 13.

A fixing portion 65 to which the adapter 61 of the liquid container 20A is fitted, and that thereby fixes the position at which the liquid container 20A is arranged is provided at a leading end portion of the container 13. The fixing portion 65 is constituted by a pair of side wall blocks 65*bk*, a section in the leading end wall 70 that faces the adapter 61 in the D direction, a notch 65*a* provided in a leading end portion of the bottom wall 67, and a pair of guiding portions 73.

The pair of side wall blocks 65*bk* are rectangular sections provided at a corner between the leading end wall 70 and the bottom wall 67. The pair of side wall blocks 65*bk* sandwich the adapter 61 in the width direction, and restrict movement of the adapter 61 in the width direction.

The section in the leading end wall 70 that faces the adapter 61 in the D direction includes the above-described bias receiving portion 57. In addition, a first hole 55*a* and the second hole 56*a* are provided in the section. The first hole 55*a* and the second hole 56*a* are through holes that constitute the entrances of the above-described positioning holes 55 and 56. The notch 65*a* has a shape in which a leading end face of the bottom wall 67 is recessed in the +D direction. An insertion potion 58 provided below the liquid outlet portion 52 of the liquid container 20A is inserted and fitted into the notch 65*a*.

The pair of guiding portions 73 are columnar sections protruding from the bottom wall 67 in the +T direction. In this embodiment, the pair of guiding portions 73 are formed to be aligned in the width direction so as to sandwich the liquid outlet portion 52 when the liquid container 20A is mounted to the container 13. The guiding portions 73 are respectively inserted into guide portions 72 provided in the adapter 61 of the liquid container 20A. The guiding portions 73 guide movement of the adapter 61 in the T direction. A direction in which the guiding portions 73 protrude is also referred to as "guiding direction". Note that, in this embodiment, the guiding portions 73 have a substantially semicircular columnar shape, and have planar restriction portions 73*a* directed in the −D direction, on the leading end side of a side face that runs along the guiding direction.

Figure 6:
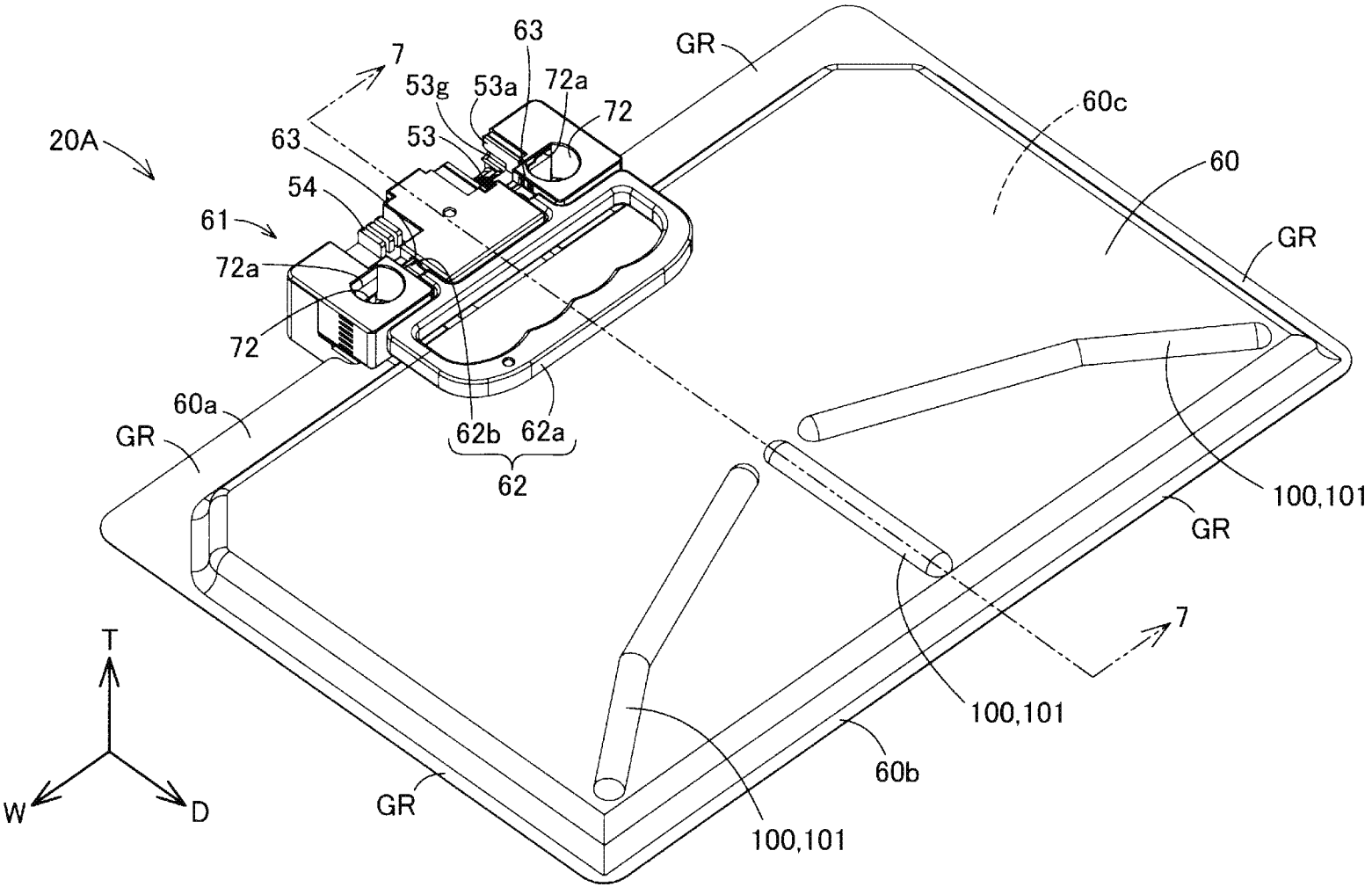
FIG. 6 is a schematic perspective view of a liquid container.

The configuration of the liquid container 20A will be described with reference to FIGS. 5 and 6. FIG. 6 is a schematic perspective view of the liquid container 20A. The liquid container 20A contains liquid that includes sedimentary components and is to be supplied to the liquid ejection apparatus 11. "Sedimentary component" refers to a component that sinks in liquid due to gravity when the liquid is left to stand for a long time (e.g., a few hours or more). In this embodiment, sedimentary components are pigment dispersed in a solvent. The liquid container 20A is provided with a bag 60 that contains liquid and the adapter 61 in which a connection structure for connecting the adapter 61 to the liquid ejection apparatus 11 is provided.

A liquid storage portion 60*c* that is an internal space in which liquid is contained is provided inside the bag 60. When viewed in the T direction, the bag 60 has a rectangle shape in which the W direction serves as a longitudinal direction. The bag 60 is flexible. The shape of the bag 60 may be a pillow type or a gusset type. In this embodiment, the bag 60 is a pillow type bag that is formed by overlapping two rectangular films and joining the peripheral edges of the films to each other, and has a gusset portion GR formed in the periphery of the liquid storage portion 60*c*.

The films that constitute the bag 60 are formed of a material that is flexible and has gas barrier properties. Examples of the material of the films include polyethylene terephthalate (PET), nylon, polyethylene, and the like. In addition, the films may be formed using a layered structure in which a plurality of films made of such materials are layered. In such a layered structure, for example, a configuration may be adopted in which the outer layer is made of PET or nylon that has excellent impact resistance, and the inner layer is made of polyethylene that has excellent ink resistance. Furthermore, a film including a layer acquired by vapor depositing aluminum or the like may be one constituent member of the layered structure.

Here, in the D direction, the end portion on the −D direction side of the bag 60 is referred to as "one edge portion 60*a*", and the end portion on the +D direction side is referred to as "other edge portion 60*b*. In the D direction, a direction directed from the one edge portion 60*a* side toward the other edge portion 60*b* side is the +D direction, and the direction opposite to the +D direction is the −D direction. The adapter 61 is attached to the one edge portion 60*a* of the bag 60. In this embodiment, the adapter 61 is attached to a central portion of the one edge portion 60*a* in the W direction.

The adapter 61 has, on a leading end side thereof, a section that constitutes the connection structure 51 of the mount body 50. The adapter 61 has the liquid outlet portion 52 at the center in the W direction thereof (see FIG. 5). The connection terminal 53, the recessed portion 53*a* in which the connection terminal 53 is contained, and the recessed guiding portion 53*g* are provided on the −W direction side of the liquid outlet portion 52 (see FIGS. 5 and 6). The identification portion 54 is provided on the −W direction side of the liquid outlet portion 52.

Furthermore, a first hole 55*b* and a second hole 56*b* are formed at the leading end of the adapter 61 (see FIG. 5). When the liquid container 20A is placed in the container 13, the first hole 55*b* is aligned with the first hole 55*a* provided in the leading end wall 70 of the container 13 in the D direction, the second hole 56*b* is aligned with the second hole 56*b* provided in the leading end wall 70 of the container 13 in the D direction. The first positioning hole 55 of the connection structure 51 is constituted by the first holes 55*a* and 55*b*, and the second positioning hole 56 of the connection structure 51 is constituted by the second holes 56*a* and 56*b* (see FIG. 4).

When the liquid container 20A is placed on the container 13, the adapter 61 is fixed to the fixing portion 65 of the container 13 (see FIG. 5). Below the adapter 61, the insertion potion 58 that is a projection structure that is inserted into the notch 65*a* provided in a leading end of the bottom wall 67 of the container 13 is provided below the liquid outlet portion 52.

In the adapter 61, the guide portions 72 into which the guiding portions 73 of the fixing portion 65 are inserted are provided on two sides of the liquid outlet portion 52 so as to be aligned in the W direction (FIGS. 5 and 6). The guide portions 72 are provided as through holes that pass through the adapter 61 in the T direction. In the inner peripheral wall faces of the guide portions 72, planar restriction portions 72*a* that face the restriction portions 73*a* of the guiding portions 73 are provided. When the guiding portions 73 are inserted into the guide portions 72, the restriction portions 72*a* and the restriction portions 73*a* respectively face each other, and thereby rotation of the liquid container 20A along the horizontal direction on the container 13 is restricted.

In the upper face of the adapter 61, a handle portion 62 formed of a material different from the material of the adapter 61 is attached (see FIGS. 5 and 6). The handle portion 62 has a grip portion 62*a* that is gripped by the user and a shaft portion 62*b* provided in a base end portion at a leading end extending from the grip portion 62*a*. In a recessed portion that is recessed from the upper face of the adapter 61 in the −T direction, as a result of the shaft portion 62*b* being inserted into a shaft receiving portion 63 that is open in the W direction, the handle portion 62 is rotatably attached to the adapter 61 such that the grip portion 62*a* rotates in the D direction. The rotation shaft of the handle portion 62 is constituted by the shaft portion 62*b* and the shaft receiving portion 63.

The handle portion 62 assumes a first orientation in which the grip portion 62*a* is positioned above the bag 60, and is positioned at a height same as or a lower than the rotation shaft of the handle portion 62, and a second orientation in which the grip portion 62*a* is separated from the bag 60, and is positioned at a position higher than the rotation shaft of the handle portion 62. FIGS. 5 and 6 illustrate a state where the handle portion 62 is in the first orientation. When the mount body 50 is mounted to the mount portion 14, the handle portion 62 is brought into the first orientation. When carrying the liquid container 20A in the state of being removed from the container 13, the user can place his or her hand on the grip portion 62*a* of the handle portion 62 in the second orientation.

A channel formation portion 100 is provided in the bag 60 (see FIGS. 5 and 6). In the state where the bag 60 is shrunk due to liquid in the bag 60 having been consumed, the channel formation portion 100 forms channels for allowing liquid to flow to the liquid outlet portion 52, in the liquid storage portion 60*c*. In this embodiment, in the flexible bag 60, the channel formation portion 100 is configured by sections formed into a shape locally inflated in the +T direction side. The channel formation portion 100 is formed as sections raised upward in the mounted orientation, and raised in a ridge shape extending along a horizontal plane. In this embodiment, it can be interpreted that the channel formation portion 100 is configured as sections whose flexibility is lower than other sections that constitute the liquid storage portion 60*c* of the bag 60, and that has a high shape maintainability.

The channel formation portion 100 can be formed through press molding in which a mold having a shape of a channel is pressed against a sheet-like flexible member that constitutes the bag 60, for example. Press molding may be performed through hot press for heating a pressing target. In this embodiment, the channel formation portion 100 is configured such that three channels 101 extending from the +D direction side of the spacer member 90 (illustrated in FIG. 7 to be referred to later), which is a solid object arranged in the bag 60, toward the spacer member 90 are formed in the liquid storage portion 60*c* (detailed description will be given later).

Figure 7:
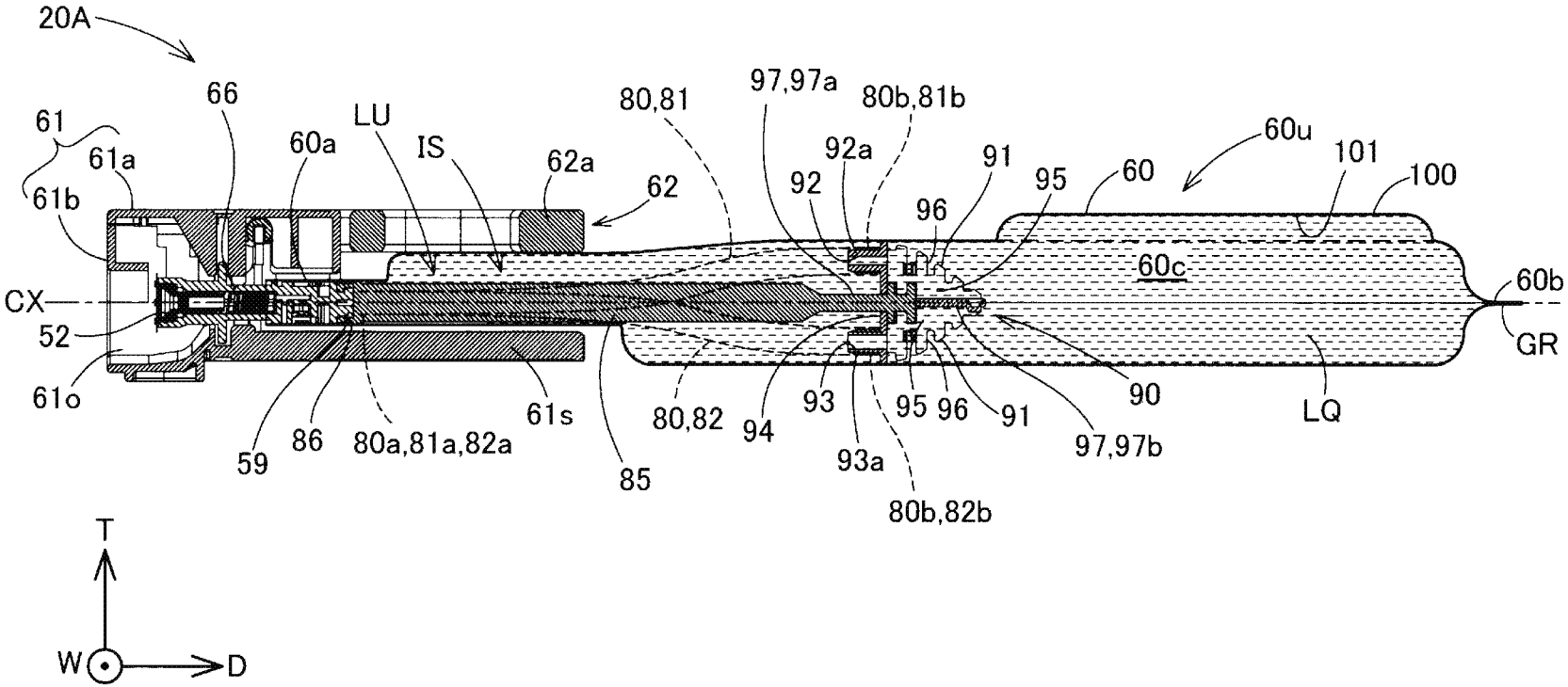
FIG. 7 is a schematic cross-sectional view of the liquid container.
Figure 8:
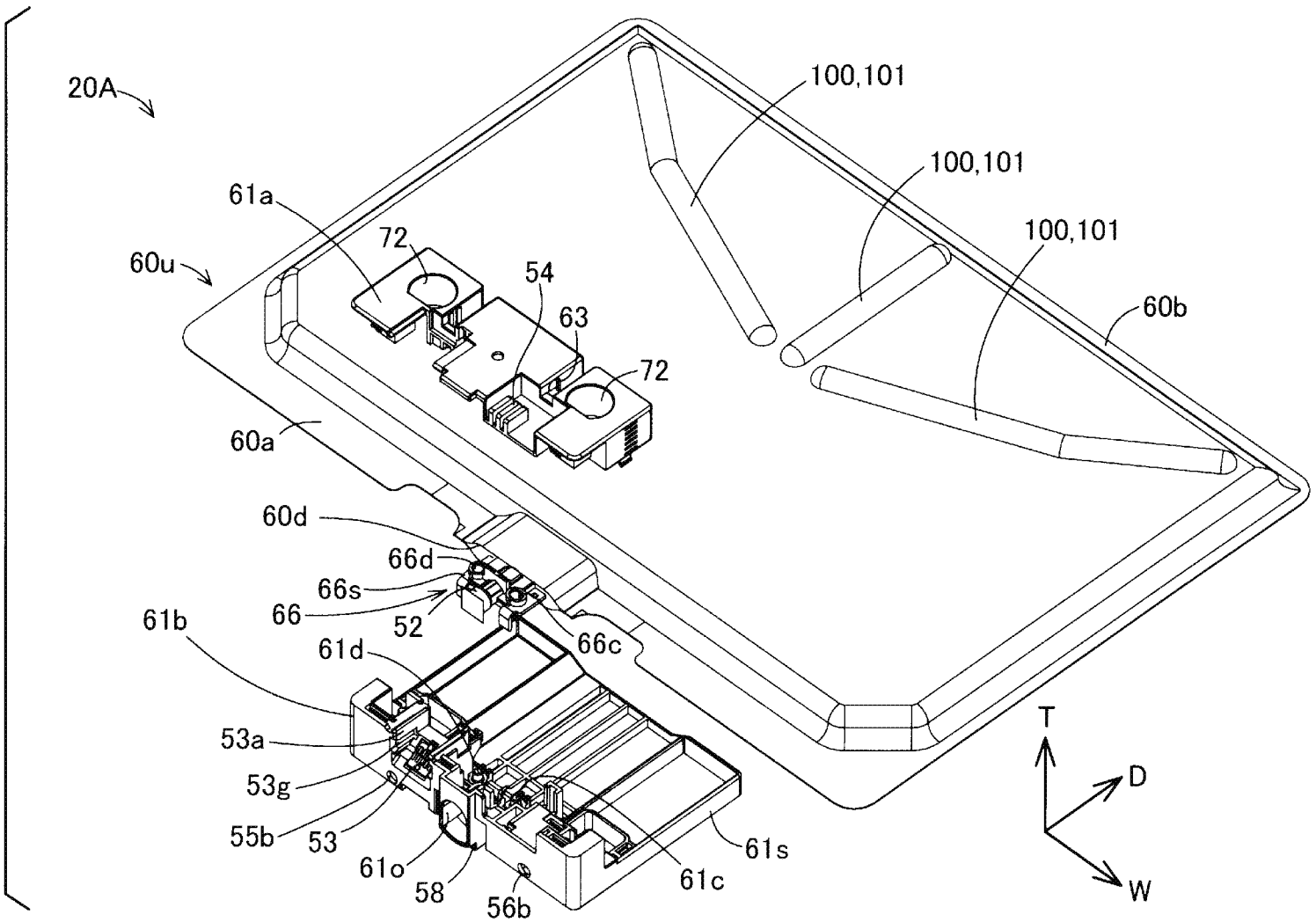
FIG. 8 is a schematic perspective exploded view of the liquid container with its adopter disassembled.
Figure 9:
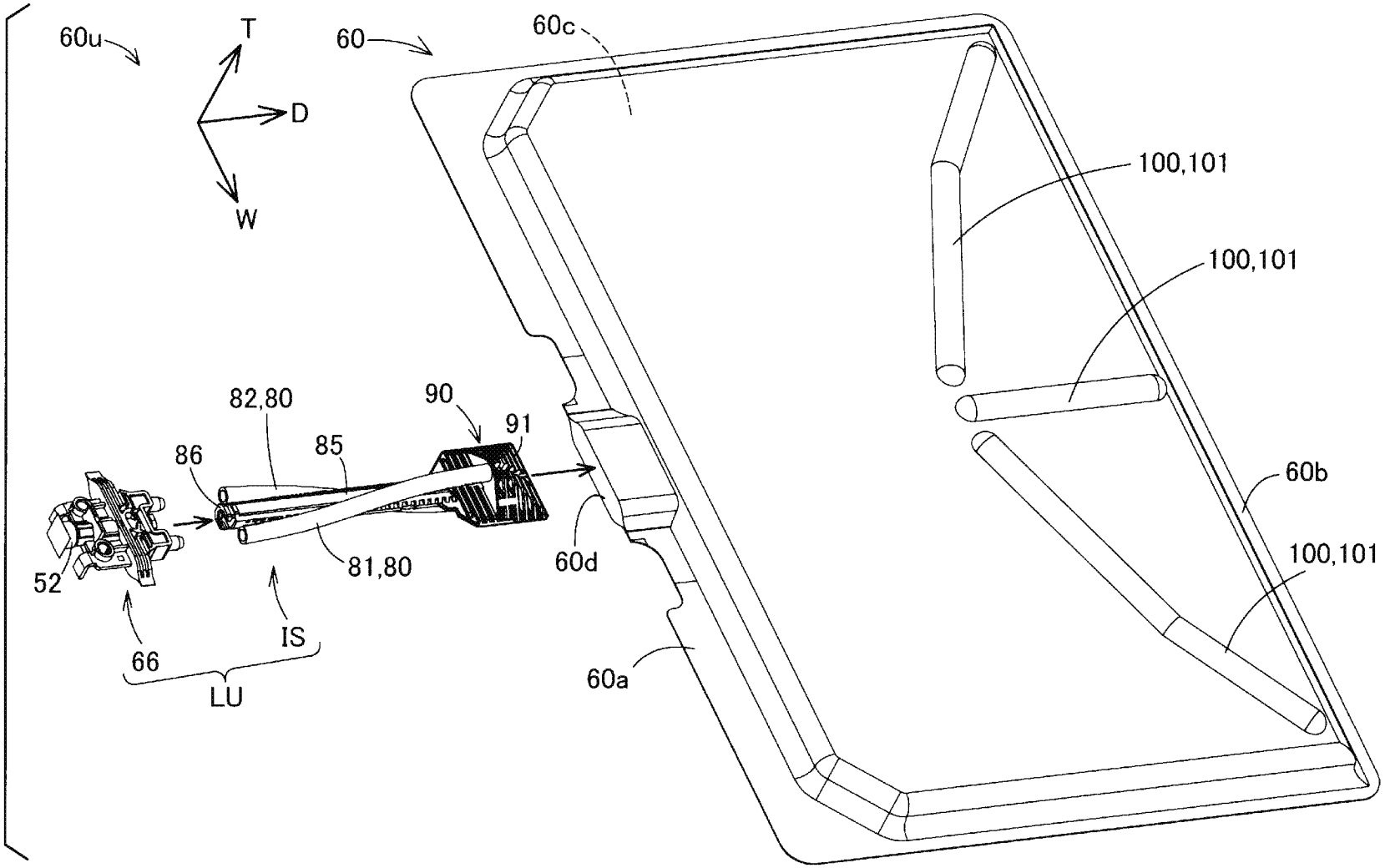
FIG. 9 is a schematic perspective exploded view showing a state where an internal structure is removed from a bag.

The internal structure of the liquid container 20A will be described with reference to FIGS. 7 to 9. FIG. 7 is a schematic cross-sectional view of the liquid container 20A cut along 7-7 shown in FIG. 6. FIG. 7 illustrates a state where a prescribed amount of liquid LQ is encapsulated in the liquid storage portion 60*c*. In FIG. 7, as a matter of convenience, a position at which the liquid outlet tube 80 is arranged indicated by broken lines. FIG. 8 is a schematic perspective exploded view of the adapter 61 of the liquid container 20A. In FIG. 8, as a matter of convenience, the handle portion 62 is not illustrated. FIG. 9 is a schematic perspective exploded view showing a state where an internal structure IS is removed from out of the bag 60 of the liquid container 20A.

The liquid container 20A has a liquid outlet member 66 integrally provided with the liquid outlet portion 52 (see FIG. 7). The liquid outlet member 66 is provided inside the adapter 61. FIG. 7 shows a central axis CX of the liquid outlet portion 52. The liquid outlet member 66 is attached to the one edge portion 60*a* of the bag 60. The liquid container 20A is provided with the internal structure IS, in the liquid storage portion 60*c* provided in the bag 60. The internal structure IS includes the liquid outlet tube 80, a coupling member 85, and the spacer member 90.

In the liquid storage portion 60*c*, the liquid outlet tube 80 constitutes a flow path through which liquid flows.

The liquid outlet tube 80 is constituted by a flexible tube made of an elastomer, for example. In this embodiment, the liquid outlet tube 80 includes a first conduit portion 81 and a second conduit portion 82, and is constituted by two tubes (to be described in detail later). In another embodiment, the liquid container 20A may have three or more liquid outlet tubes 80, or may have only one liquid outlet tube 80.

The liquid outlet tube 80 has a base end portion 80*a* connected to the liquid outlet member 66, in the liquid storage portion 60*c*. The base end portion 80*a* includes a first base end portion 81*a* of the first conduit portion 81 and a second base end portion 82*a* of the second conduit portion 82. In the liquid outlet member 66, a channel for bringing the liquid outlet tube 80 and the liquid outlet portion 52 into communication with each other is formed (not illustrated).

The liquid outlet tube 80 extends from the liquid outlet member 66 toward the other edge portion 60*b* side in the liquid storage portion 60*c*. In this embodiment, the liquid outlet tube 80 is arranged in the liquid storage portion 60*c* to extend in the horizontal direction in the mounted orientation. The liquid outlet tube 80 extends from the liquid outlet member 66 toward the spacer member 90 arranged inside the liquid storage portion 60*c*.

In this embodiment, a leading end portion 80*b* of the liquid outlet tube 80 is connected to the spacer member 90. The leading end portion 80*b* includes a first leading end portion 81*b* of the first conduit portion 81 and a second leading end portion 82*b* of the second conduit portion 82. The liquid LQ is introduced into the liquid outlet tube 80 through a first introduction port 92 and a second introduction port 93 provided as through holes passing through the spacer member 90 in the D direction. Connection between the liquid outlet tube 80 and the first introduction port 92 and the second introduction port 93 will be described later.

The spacer member 90 is a structure for defining a region having a certain volume in the liquid storage portion 60*c* in the bag 60. The spacer member 90 is made of a synthetic resin such as polyethylene or polypropylene. The spacer member 90 has a portion positioned on the +D direction side relative to the liquid outlet tube 80. In this embodiment, the spacer member 90 is arranged at a position intersecting a TD plane that includes the central axis CX of the liquid outlet portion 52. The TD plane refers to a virtual plane that includes and is parallel to the T direction and the D direction.

In the state where the internal structure IS is contained in the liquid storage portion 60*c*, the height in the T direction of the spacer member 90 is largest in the internal structure IS. In the mounted orientation in which the liquid container 20A is mounted in the liquid ejection apparatus 11, at least one of the lowermost portion and the uppermost portion of the spacer member 90 is in contact with an inner face of the bag 60. In this embodiment, if a prescribed amount of the liquid LQ is encapsulated in the liquid container 20A, both the lowermost portion and the uppermost portion of the spacer member 90 are in contact with the internal face of the bag 60 as shown in FIG. 7. In this embodiment, in the mounted orientation, the center between the heights of the lowermost portion and the uppermost portion of the spacer member 90 is the same as the height of the central axis CX of the liquid outlet portion 52.

As described above, in the liquid container 20A, in a section in which the spacer member 90 is arranged, direct contact between faces of the bag 60 that face each other in the T direction is prevented due to the spacer member 90. Therefore, even if liquid contained in the bag 60 is consumed and the bag 60 shrinks, a space that liquid can enter is formed in the periphery of the spacer member 90. A specific shape of the spacer member 90 in this embodiment will be described later.

In this embodiment, the spacer member 90 is fixed to the liquid outlet member 66 by the bar-like coupling member 85. The coupling member 85 is arranged to extend in the D direction along the central axis CX of the liquid outlet portion 52, and is coupled to the liquid outlet member 66 at an engagement portion 86 provided in the end portion on the −D direction side, and the end portion on the +D direction side of the coupling member 85 is coupled to the spacer member 90. The coupling structure of the coupling member 85 to the liquid outlet member 66 and the spacer member 90 will be described later. The coupling member 85 may be made of synthetic resin similar to the spacer member 90, or may be made of another different material.

As a result of the spacer member 90 being fixed to the liquid outlet member 66, the positional relationship between the spacer member 90 and the liquid outlet member 66 is stabilized. Therefore, change of the position at which the spacer member 90 is arranged in the liquid storage portion

60*c* is suppressed for each liquid container 20A, and change of the performance of supplying liquid to the liquid ejection apparatus 11 is suppressed for liquid container 20A.

The liquid container 20A of this embodiment is configured such that the center in the height direction (the T direction) of the spacer member 90 and the height of the central axis CX of the liquid outlet portion 52 are the same in the mounted orientation (see FIG. 7). Therefore, it is possible to stabilize the position in the up-down direction of the liquid outlet portion 52 relative to the container 13, and connection to the liquid ejection apparatus 11 is made easy.

In this embodiment, the above-described channel formation portion 100 is provided on the +D direction side relative to the spacer member 90 (see FIG. 7). As described above, in this embodiment, the channel formation portion 100 is configured as sections formed by locally inflating the bag 60 on the +T direction side. In the bag 60 of this embodiment, the channel formation portion 100 is provided on an upward-facing face side, in the mounted orientation.

Even when the liquid LQ in the liquid storage portion 60*c* is consumed and the bag 60 gradually shrinks, contact between the internal faces of the bag 60 that are opposed to each other in the T direction, in the sections in which the channel formation portion 100 is formed, is delayed than in other sections. Therefore, when the bag 60 shrinks and the internal space of the bag 60 is collapsed in the periphery of the channel formation portion 100, the internal spaces of the channel formation portion 100 are not collapsed and are maintained, and function as the directing channels 101 for directing liquid. The directing channels 101 extend from an end portion side of the liquid storage portion 60*c* in a direction approaching the spacer member 90, and thus a state is maintained in which the liquid LQ that retains on the end portion side of the liquid storage portion 60*c* can be directed to the liquid outlet tube 80 that is positioned near the spacer member 90, through the directing channels 101.

In the state of being coupled to the liquid outlet member 66, the internal structure IS is inserted into the liquid storage portion 60*c* through an opening portion 60*d* provided in advance on the one edge portion 60*a* side of the bag 60 (see FIG. 9). Hereinafter, a part in which the liquid outlet member 66 and the internal structure IS are coupled and integrated is also referred to as "liquid outlet unit LU". In this embodiment, the opening portion 60*d* is provided substantially at the center in the W direction of the bag 60. The liquid outlet unit LU is inserted to a predetermined position at which the liquid outlet portion 52 of the liquid outlet member 66 protrudes from the opening portion 60*d* (see FIG. 8).

The liquid outlet member 66 is fixed to the bag 60 by an inner peripheral face of the opening portion 60*d* of the bag 60 being welded to an outer peripheral face of the liquid outlet member 66. Due to welding of the opening portion 60*d* to the liquid outlet member 66, in the liquid storage portion 60*c*, an opening leading to the outside other than a channel in the liquid outlet member 66 is blocked. Hereinafter, the bag 60 into which the spacer member 90 and the liquid outlet tube 80 are inserted, and in which the opening portion 60*d* is welded to the liquid outlet member 66 is also referred to as "bag unit 60*u*". Note that the coupling structure of the internal structure IS to the liquid outlet member 66 and a welding section of the liquid outlet member 66 to the bag 60 will be described in detail later with reference to other figures for reference.

The adapter 61 is constituted by a lid member 61*a* and a bottom member 61*b* that can be separated in the T direction (see FIG. 8). The lid member 61*a* and the bottom member 61*b* sandwich, from the +T direction side and the −T direction side, the one edge portion 60*a* on the −D direction side of the bag unit 60*u* that includes the liquid outlet portion 52 of the liquid outlet member 66 protruding in the −D direction, and thereby the adapter 61 is fixed to the bag unit 60*u*.

The identification portion 54 of the adapter 61 is provided on the lid member 61*a* side. The connection terminal 53, the recessed portion 53*a* in which the connection terminal 53 is arranged, and the insertion potion 58 are provided on the bottom member 61*b* side. In addition, in the bottom member 61*b*, an opening portion 61*o* for guiding the introduction needle 32 (illustrated in FIG. 3) to the liquid outlet portion 52 inside is provided above on the insertion potion 58.

In this embodiment, a first protrusion 61*c* and a second protrusion 61*d* are provided in the bottom member 61*b* so as to protrude in the +T direction. The first protrusion 61*c* and the second protrusion 61*d* are provided to be aligned in the W direction. A fixing portion 66*s* is provided at a portion of the liquid outlet member 66 that is exposed from the bag 60 in the −D direction. In the fixing portion 66*s*, a first through hole 66*c* and a second through hole 66*d* are provided at positions sandwiching the liquid outlet portion 52 in the W direction.

When the adapter 61 is fixed to the bag unit 60*u*, the first protrusion 61*c* of the bottom member 61*b* is inserted into the first through hole 66*c* of the liquid outlet member 66. In addition, the second protrusion 61*d* of the bottom member 61*b* is inserted into the second through hole 66*d* of the liquid outlet member 66. Moreover, the liquid outlet portion 52 is arranged between the first protrusion 61*c* and the second protrusion 61*d* of the bottom member 61*b*. A portion of the end portion on the −D direction side of the bag 60 as well as the fixing portion 66*s* of the liquid outlet member 66 are sandwiched between the lid member 61*a* and the bottom member 61*b*.

Figure 10:
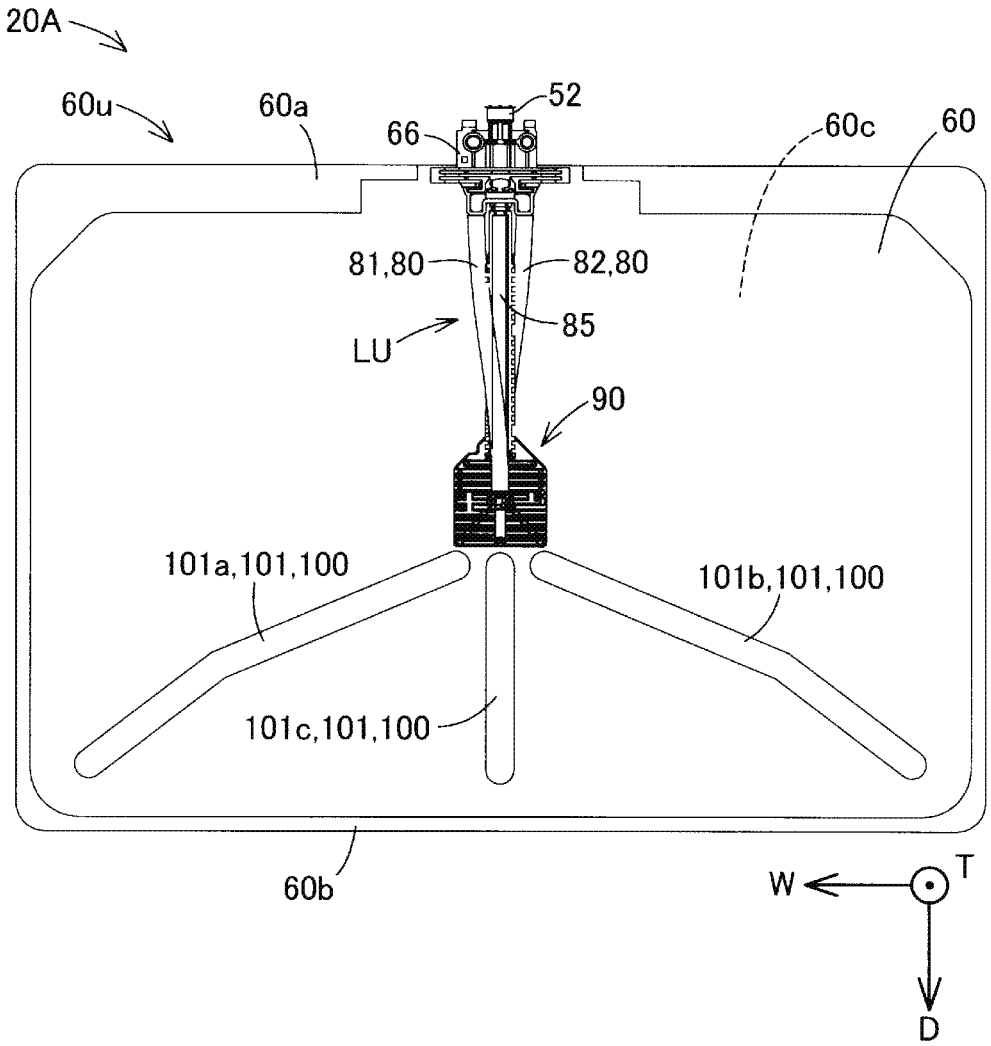
FIG. 10 is a schematic plane view of a bag unit.

The directing channels 101 formed in the liquid container 20A by the channel formation portion 100 will be described with additional reference to FIG. 10. FIG. 10 is a schematic plane view of the bag unit 60*u* when viewed in the −T direction. As a matter of convenience, FIG. 10 illustrates the entire liquid outlet unit LU to be visible through the bag 60.

The channel formation portion 100 extends along the DW plane from the outer peripheral end portion side of the liquid storage portion 60*c* in a direction approaching the spacer member 90, and forms, in the liquid storage portion 60*c*, at least one directing channel 101 that directs the liquid LQ toward the spacer member 90. Here, "DW plane" is a virtual plane that includes the D direction and the W direction, and is a virtual plane parallel to the D direction and the W direction. In this embodiment, the channel formation portion 100 is configured to form the three directing channels 101 extending from the +D direction side of the spacer member 90 in a direction approaching the spacer member 90.

The three directing channels 101 of this embodiment include a first inclined channel 101*a*, a second inclined channel 101*b*, and a central channel 101*c*. The first inclined channel 101*a* and the second inclined channel 101*b* each extend from the +D direction side of the spacer member 90 and from one direction side out of the directions along the W direction, in a direction approaching the spacer member 90. The first inclined channel 101*a* and the second inclined channel 101*b* extend obliquely relative to the D direction individually.

The first inclined channel 101*a* extends from the +D direction side and the +W direction side of the spacer member 90 in a direction approaching the spacer member 90. The second inclined channel 101*b* extends from the +D direction side and the −W direction side of the spacer member 90 in a direction approaching the spacer member 90. In this embodiment, the first inclined channel 101*a* and the second inclined channel 101*b* extend from the end portions in the W direction of the liquid storage portion 60*c* to the spacer member 90 arranged at the center in the W direction.

The central channel 101*c* is positioned between the first inclined channel 101*a* and the second inclined channel 101*b* in the W direction, and extends from the +D direction side of the spacer member 90 in a direction approaching the spacer member 90. In this embodiment, the central channel 101*c* extends along the D direction at the center in the W direction of the liquid storage portion 60*c*.

The end portions on the spacer member 90 side of the channels 101*a*, 101*b*, and 101*c* are desirably positioned in a region in a vicinity of a certain range from the spacer member 90. The end portions on the spacer member 90 side of the channels 101*a*, 101*b*, and 101*c* are desirably positioned in a region so as to leave a space in the periphery of the spacer member 90 when the amount of liquid in the liquid storage portion 60*c* reaches a lower limit amount that has been set in advance in the liquid ejection apparatus 11. The other edge portions of the channels 101*a*, 101*b*, and 101*c* are desirably positioned at positions closer to end portions of the liquid storage portion 60*c* in a direction along the DW plane.

According to the liquid container 20A, the liquid outlet tube 80 is provided in the liquid storage portion 60*c* provided in the bag 60, and thus a liquid channels are secured by a space in the periphery of the liquid outlet tube 80, and the channels in the bag 60 are unlikely to be blocked. In addition, the liquid outlet tube 80 extends from the liquid outlet member 66 toward the spacer member 90, and the spacer member 90 is positioned on the farther side (the +D direction side) relative to the end portion on the +D direction side of the liquid outlet tube 80. Therefore, the end portion on the +D direction side of the liquid outlet tube 80 as well as channels on the farther side thereof are unlikely to be blocked. Thus, it is possible to suppress inhibition of flow of liquid in the bag 60. In addition, it is possible to keep liquid and sedimentary components from remaining in the liquid container 20A.

In addition, the liquid container 20A has the directing channels 101 formed using the channel formation portion 100. The directing channels 101 extend from the end portion sides of the liquid storage portion 60*c* so as to approach the spacer member 90. Liquid at a position separated from the spacer member 90 is directed from the end portion sides of the liquid storage portion 60*c* toward the spacer member 90 by the directing channels 101. Therefore, flow of liquid at a position separated from the spacer member 90 is maintained by the directing channels 101, and also at a position separated from the spacer member 90, blockage of a channel in the bag 60 is suppressed. In addition, liquid and sedimentary components are kept from remaining also in a region separated from the spacer member 90.

In the liquid container 20A of this embodiment, it is possible to suppress blockage of channels in a region on the +W direction side and a region on the −W direction side relative to the spacer member 90 in a region on the +D direction side, using the first inclined channel 101*a* and the second inclined channel 101*b*. In addition, liquid and sedimentary components are kept from remaining in these regions. In particular, in this embodiment, the first inclined channel 101*a* and the second inclined channel 101*b* extend from the corner of the liquid storage portion 60*c* on the +D direction side. Therefore, liquid and sedimentary components are kept from remaining at such a corner.

In the liquid container 20A of this embodiment, it is possible to suppress, using the central channel 101*c*, blockage of channels in a region sandwiched by the first inclined channel 101*a* and the second inclined channel 101*b* in the W direction. In addition, liquid in these regions are kept from remaining. In particular, the central channel 101*c* extends from the end portion on the +D direction side of the liquid storage portion 60*c* to almost reach the spacer member 90, and thus liquid and sedimentary components are kept from remaining in the end portion on the +D direction side of the liquid storage portion 60*c*. In this manner, in the liquid container 20A of this embodiment, it is possible to suppress blockage of channels on the +D direction side relative to the spacer member 90 using the three channels 101*a* to 101*c*. In addition, liquid and sedimentary components are kept from remaining in these regions.

Figure 11:
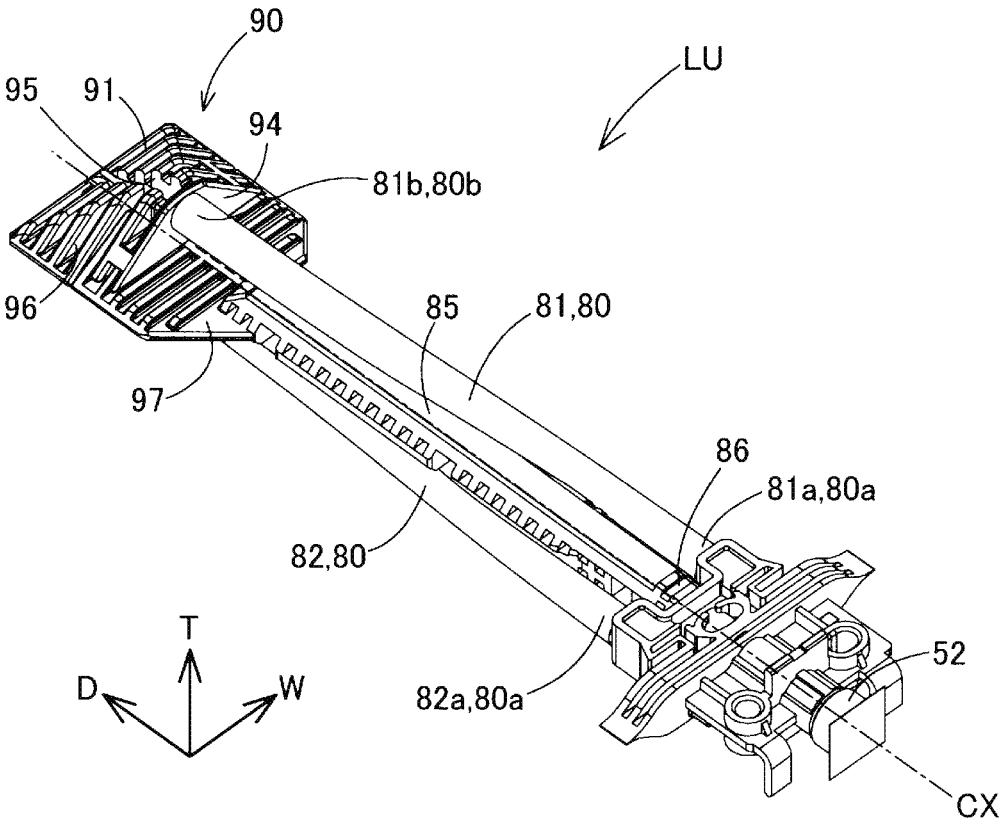
FIG. 11 is a schematic perspective view of a liquid outlet unit.
Figure 12:
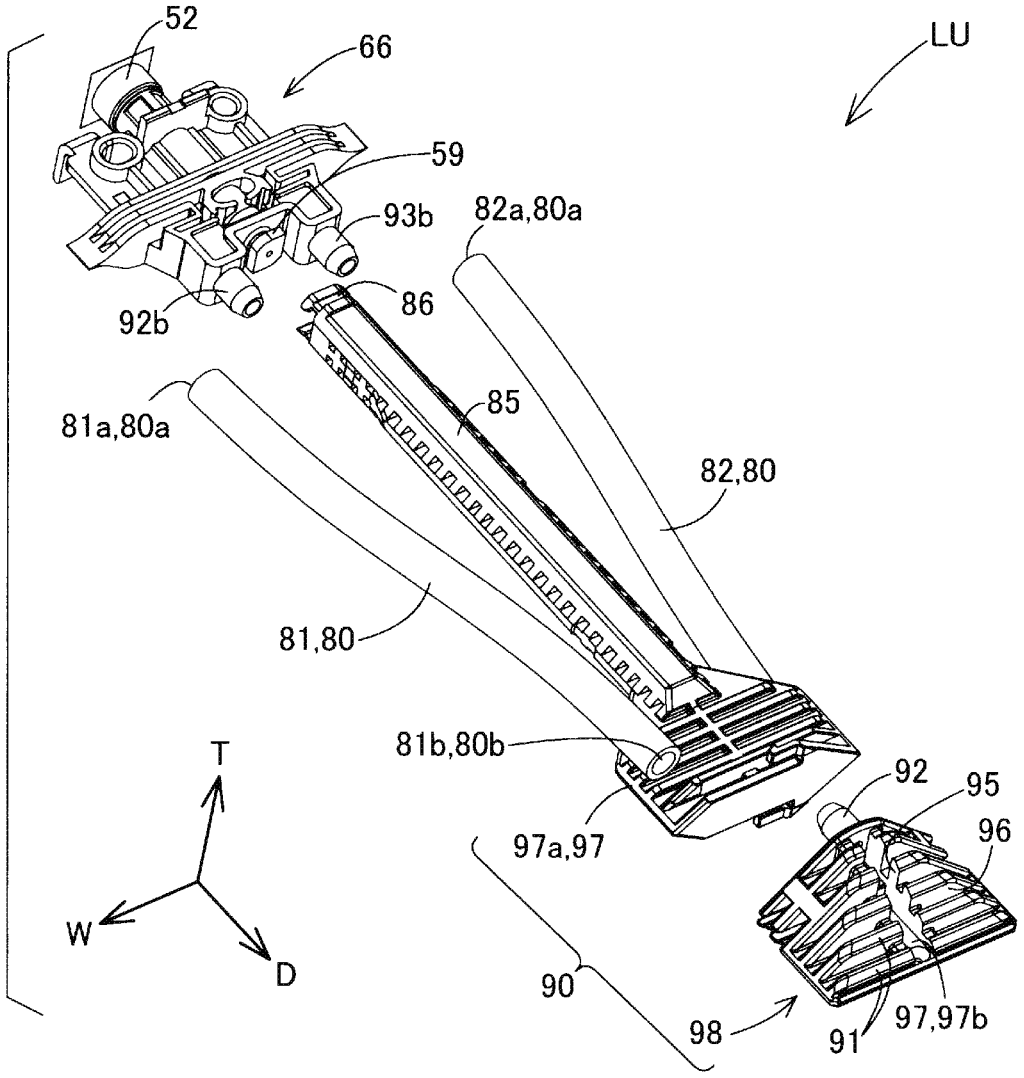
FIG. 12 is a schematic perspective exploded view of the liquid outlet unit.
Figure 13:
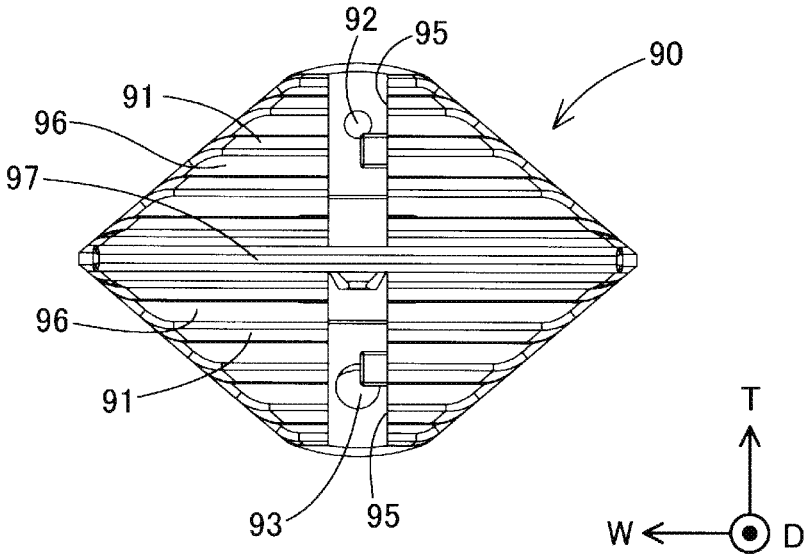
FIG. 13 is a schematic front view of a spacer member.
Figure 14:
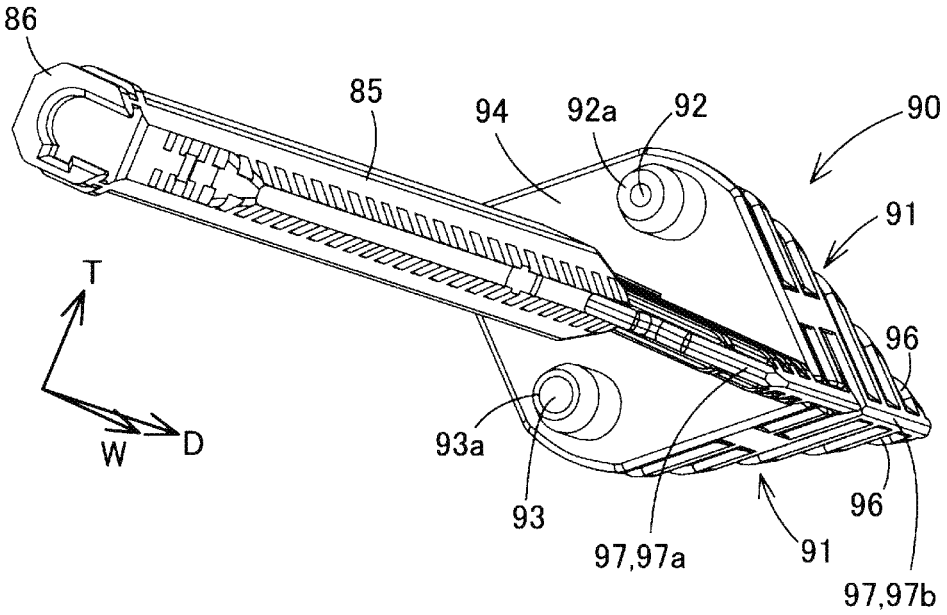
FIG. 14 is a schematic perspective view of an internal structure.

Detailed configurations of sections in the liquid outlet unit LU will be described with reference to FIGS. 11 to 14. FIG. 11 is a schematic perspective view of the liquid outlet unit LU. FIG. 12 is a schematic perspective exploded view of the liquid outlet unit LU. FIG. 13 is a schematic front view showing the front face side (the +D direction side) of the spacer member 90. FIG. 14 is a schematic perspective view showing the back face side (the −D direction side) of the spacer member 90 on which the coupling member 85 is coupled to the spacer member 90.

The spacer member 90 has, on the front side (the +D direction side) thereof, inclined faces 91 that are faces inclined such that the dimension along the T direction of the spacer member 90 increases toward the −D direction side from the +D direction side (see FIGS. 11, 12, 14, and 7). In this embodiment, "face" is not only a face composed of a continuous flat face only, and may be a face in which grooves, recessed portions, holes, slits, and the like are formed on its surface, a face in which protrusion and projection are formed on its surface, or a virtual plane surrounded by a frame. That means, a certain region occupied by what can be appreciated as a "face" in its overall perspective may include recessions and protrusions and through holes.

In this embodiment, the spacer member 90 has the inclined faces 91 respectively on the +T direction side and the −T direction side relative to the central axis CX of the liquid outlet portion 52 (FIG. 7). Therefore, when viewed from the W direction, the spacer member 90 has a shape pointed on the +D direction side (see FIG. 14).

As a result of the spacer member 90 being provided with the inclined faces 91 in this manner, the bag 60 is likely to gradually collapse along the inclined faces 91 from the +D direction side to the −D direction side when the bag 60 shrinks as liquid is consumed. Thus, on the farther side (the +D direction side) of the spacer member 90, it is possible to more effectively suppress collapse of the bag 60 and generation of a section in which flow of liquid is blocked. In addition, when the bag 60 shrinks to come into contact with the spacer member 90, the bag 60 shrinks along the inclined faces 91, and thus bending and folding of the bag 60 in the periphery of the spacer member 90 is suppressed. Thus, occurrence of transformation that causes stress concentration in the bag 60 in the periphery of the spacer member 90 is suppressed, and deterioration of the bag 60 is suppressed. Additionally, when the bag 60 shrinks to the extent of coming into contact with the inclined faces 91 of the spacer member 90 so as to cover the inclined faces 91, a space in the liquid storage portion 60*c* that remains on the +D direction side of the spacer member 90 is reduced. Therefore, liquid is kept from remaining in such a space.

In this embodiment, in the mounted orientation, at least one of the lowermost portion and the uppermost portion of the spacer member 90 comes into contact with an internal face of the bag 60 (see FIG. 7). Therefore, the bag 60 is likely to shrink from a portion of contact with the spacer member 90 along the shape of the inclined faces 91 of the spacer member 90, and it is possible to more effectively suppress blockage of channels in the liquid storage portion 60*c*.

The inclined face 91 does not need to be provided on both the +T direction side and the −T direction side of the spacer member 90, and may be formed on one of the +T direction side and the −T direction side. However, if the inclined face 91 is provided on both the +T direction side and the −T direction side of the spacer member 90 as in this embodiment, it is possible to make it easy for the bag 60 to be collapsed gradually from the +D direction side toward the −D direction side more smoothly, than in the case where the inclined face 91 is provided only on either one of the +T direction side or the −T direction side.

In the spacer member 90, the first introduction port 92 and the second introduction port 93 for introducing liquid are provided so as to pass through the spacer member 90 in the D direction (see FIGS. 7 and 13). In this embodiment, the first introduction port 92 and the second introduction port 93 extend in parallel along the central axis CX of the liquid outlet portion 52, inside the spacer member 90 (see FIG. 7). The first introduction port 92 and the second introduction port 93 are open in the D direction, on the front side of the spacer member 90 (see FIG. 13).

The first introduction port 92 and the second introduction port 93 are aligned in the T direction (see FIGS. 7 and 14). In the mounted orientation, the first introduction port 92 and the second introduction port 93 are aligned in the vertical direction, and the first introduction port 92 is positioned above the second introduction port 93. The first introduction port 92 and the second introduction port 93 are arranged sandwiching the central axis CX of the liquid outlet portion 52 (see FIG. 7). The liquid LQ above the central axis CX in the liquid storage portion 60*c* is introduced into the first conduit portion 81 through the first introduction port 92. The liquid LQ below the central axis CX in the liquid storage portion 60*c* is introduced into the second conduit portion 82 through the second introduction port 93.

In this embodiment, the internal diameter of the first introduction port 92 is smaller than the internal diameter of the second introduction port 93 (see FIGS. 7 and 13). In other words, the internal diameter of the second introduction port 93 is larger than the internal diameter of the first introduction port 92. Therefore, the second introduction port 93 positioned below the first introduction port 92 has smaller channel resistance, and more easily suctions liquid that contains a large amount of sedimentary components and has a high concentration. Thus, liquid in a lower layer that has a high concentration due to sedimentary components having sunken can be efficiently directed to the liquid outlet tube 80. The difference of inner diameter between the first introduction port 92 and the second introduction port 93 is desirably determined such that the ratio between the flow rate of liquid that flows into the first conduit portion 81 and the flow rate of liquid that flows into the second conduit portion 82 take defined values.

The spacer member 90 has a back face portion 94 arranged along the vertical direction, on the opposite side to the inclined faces 91 in the D direction (see FIG. 14). In this embodiment, the back face portion 94 has a substantially hexagonal shape when viewed in the +D direction. The upper side and base of the back face portion 94 extend in the horizontal direction while being bent slightly. This stabilizes arrangement orientation of the spacer member 90 in the mounted orientation.

A first cylindrical connection tube 92*a* the center of which the first introduction port 92 passes through and a second cylindrical connection tube 93*a* the center of which the second introduction port 93 passes through are provided in the back face portion 94 (see FIG. 14). The first connection tube 92*a* and the second connection tube 93*a* protrude in the −D direction, in the back face portion 94. The first connection tube 92*a* and the second connection tube 93*a* are aligned in the T direction. In the mounted orientation, the first connection tube 92*a* and the second connection tube 93*a* are aligned in the vertical direction, and the first connection tube 92*a* is positioned above the second connection tube 93*a*.

The first conduit portion 81 in the liquid outlet tube 80 is connected to the first introduction port 92 by the first connection tube 92*a* being inserted at the first leading end portion 81*b* of the first conduit portion 81 (see FIGS. 11 and 12). The second conduit portion 82 in the liquid outlet tube 80 is connected to the second introduction port 93 (FIG. 14) by the second connection tube 93*a* being inserted at the second leading end portion 82*b* of the second conduit portion 82. In the liquid container 20A, the first leading end portion 81*b* and the second leading end portion 82*b* are fixed in the state of being aligned in the vertical direction, and movement in the W direction is suppressed. Therefore, it is possible to suck liquid at a stable position. In addition, increase in the width in the W direction of a region in the liquid storage portion 60*c* in which the liquid outlet tube 80 is arranged is suppressed in a connection section in which the liquid outlet tube 80 is connected to the spacer member 90.

In this embodiment, the first leading end portion 81*b* of the first conduit portion 81 and the second leading end portion 82*b* of the second conduit portion 82 are individually fixed to the spacer member 90. Accordingly, deviation from arrangement positions of the first leading end portion 81*b* and the second leading end portion 82*b* that serve as entrances for taking liquid in the liquid storage portion 60*c* into the liquid outlet tube 80, the arrangement positions having been defined in advance in the liquid storage portion 60*c*, is suppressed. In addition, even if an impact is applied to the liquid container 20A due to the liquid container 20A being dropped or the like when it is carried, separation of the liquid outlet tube 80 and the spacer member 90 from each other is suppressed. Therefore, inhibition of flow of liquid into the liquid outlet tube 80 due to the first leading end portion 81*b* and the second leading end portion 82*b*, which are entrances of liquid, being arranged in sections in which liquid does not easily flow due to the bag 60 being collapsed is suppressed.

Note that, in another embodiment, at least one of the first leading end portion 81*b* of the first conduit portion 81 and the second leading end portion 82*b* of the second conduit portion 82 may be separated without being connected to the spacer member 90. Liquid may be directly introduced into the liquid outlet tube 80 from an opening end portion that is arranged to be open at a position separated from the spacer member 90.

The spacer member 90 is provided with first groove channels 95 and second groove channels 96 (see FIGS. 12 and 13), which have a groove-like shape. The first groove channels 95 are channels for directing liquid from the +D direction to the first introduction port 92 and the second introduction port 93 positioned in the −D direction. The first groove channels 95 are formed as grooves extending in the D direction in the inclined faces 91 (see FIG. 12). The first groove channels 95 are provided in the inclined face 91 on the +T direction side and the inclined face 91 on the −T direction side. The first introduction port 92 and the second introduction port 93 are open at deep positions of the first groove channels 95 (see FIGS. 7 and 13).

The second groove channels 96 are channels for allowing liquid to flow in a direction intersecting the D direction (see FIG. 11). In this embodiment, a plurality of second groove channels 96 are formed. The second groove channels 96 are configured as grooves extending along the W direction in the inclined faces 91 of the spacer member 90 (see FIG. 7). The second groove channels 96 are provided on the two sides in the W direction relative to the first groove channels 95, and join the first groove channels 95.

Even if the bag 60 shrinks and the surface of the spacer member 90 is covered by the internal face of the bag 60, blockage of a liquid path leading to the first introduction port 92 and the second introduction port 93 is suppressed by providing the first groove channels 95 and the second channels 96. Note that, the first groove channels 95 may be formed to extend obliquely relative to the D direction. In addition, the second groove channels 96 may be formed to allow liquid to flow in a direction intersecting both the W direction and the D direction. In another embodiment, the first groove channels 95 or the second channels 96 can be omitted.

In this embodiment, the spacer member 90 is provided with a plate-like partition portion 97 that is arranged along a horizontal plane (the DW plane) in the mounted orientation (See FIG. 11). The partition portion 97 is provided between the first introduction port 92 and the second introduction port 93 (See FIG. 14). The partition portion 97 is arranged so as to include the central axis CX of the liquid outlet portion 52 (FIG. 7). The partition portion 97 is arranged horizontally at the center of the liquid storage portion 60*c*.

The partition portion 97 has a first section 97*a* attached to extend in the −D direction from the back face portion 94 and a second section 97*b* extending between the upper and lower inclined faces 91 to divide a space in the first groove channel 95 vertically (see FIGS. 7 and 12). In this embodiment, the first section 97*a* of the partition portion 97 is provided as the end portion on the +D direction side of the coupling member 85, and is configured to be separable from the back face portion 94 (see FIG. 12). The second section 97*b* has the back face portion 94 and the inclined face 91, and is included in a front member 98 that constitutes the front face side of the spacer member 90.

Mixing of liquid with a low concentration that is on an upper side in the liquid storage portion 60*c* and liquid with a high concentration that is on a lower side is suppressed by the partition portion 97 in the vicinity of the spacer member 90. Therefore, it is possible to suppress difficulty in suctioning liquid with a high concentration due to the liquid with a low concentration being suctioned into both the first conduit portion 81 and the second conduit portion 82. As a result, it is possible to further stabilize the concentration of liquid that is supplied to the liquid ejection apparatus 11. Note that, in another embodiment, the partition portion 97 may be omitted.

At the first base end portion 81*a*, the first conduit portion 81 is connected to the liquid outlet member 66, and at the second base end portion 82*a*, the second conduit portion 82 is connected to the liquid outlet member 66 (see FIG. 11). In the end portion on the +D direction side of the liquid outlet member 66, a third cylindrical connection tube 92*b* and a fourth cylindrical connection tube 93*b* are provided to protrude in the +D direction (see FIG. 12). The third connection tube 92*b* and the fourth connection tube 93*b* are arranged to be aligned in the W direction and sandwich a connection portion 59 for coupling the coupling member 85 to the liquid outlet member 66. The third connection tube 92*b* and the fourth connection tube 93*b* are in communication with the liquid outlet portion 52 via a merging portion (not illustrated) in the liquid outlet member 66. The third connection tube 92*b* is inserted at the base end portion 81*a* of the first conduit portion 81, and the fourth connection tube 93*b* is inserted into the second base end portion 82*a* of the second conduit portion 82, whereby the liquid outlet tube 80 is fixed to the liquid outlet member 66.

In this embodiment, in the mounted orientation, the first base end portion 81*a* of the first conduit portion 81 and the second base end portion 82*a* of the second conduit portion 82 are arranged to be aligned in the horizontal direction (see FIGS. 7 and 11). Conversely, as described above, the first leading end portion 81*b* of the first conduit portion 81 and the second leading end portion 82*b* of the second conduit portion 82 are aligned in the vertical direction in the mounted orientation.

Therefore, liquid suctioned in from the first conduit portion 81 and liquid suctioned in from the second conduit portion 82 are converted from a state of flowing in parallel in the vertical direction to a state of flowing in parallel in the horizontal direction, are then mixed in the liquid outlet member 66, and are led out from the liquid outlet portion 52 to the liquid ejection apparatus 11. As described above, as a result of mixing liquid with different concentrations at the same height position in the liquid outlet member 66, the liquid that is to be supplied to the liquid ejection apparatus 11 is effectively suppressed from being supplied in a state of uneven concentration to the liquid ejection apparatus 11. Accordingly, it is possible to supply liquid with a stable concentration to the liquid ejection apparatus 11.

Note that, in another embodiment, a mode can be adopted in which the first base end portion 81*a* and the second base end portion 82*a* are aligned in the vertical direction, and the first leading end portion 81*b* and the second leading end portion 82*b* are aligned in the horizontal direction. Alternatively, a mode may be adopted in which the first base end portion 81*a* and the second base end portion 82*a* are aligned in the vertical direction, and the first leading end portion 81*b* and the second leading end portion 82*b* are also aligned in the vertical direction. In addition, a mode may also be adopted in which the first base end portion 81*a* and the second base end portion 82*a* are aligned in the horizontal direction, and the first leading end portion 81*b* and the second leading end portion 82*b* are also aligned in the horizontal direction.

In this embodiment, the spacer member 90 is fixed to the liquid outlet member 66 using the bar-like coupling member 85 (see FIG. 11). The engagement portion 86 for fixing the coupling member 85 to the liquid outlet member 66 is provided in the end portion on the −D direction side of the coupling member 85 (see FIG. 12). The engagement portion 86 has a cylindrical shape to be open on the −D direction side and the +W direction side, and has a groove-like recessed portion formed in its inner face. In the vicinity of the end portion on the +D direction side of the liquid outlet member 66, the columnar connection portion 59 that protrudes in the +D direction, and to which the engagement portion 86 of the coupling member 85 is fixed is provided. A bar-like recessed portion is formed in the outer periphery of the connection portion 59. In this embodiment, the engagement portion 86 of the coupling member 85 is fitted into the connection portion 59 of the liquid outlet member 66 from the horizontal direction, and is rotated by 90 degrees, whereby the engagement portion 86 and the connection portion 59 are engaged with each other. Accordingly, the coupling member 85 is coupled to the liquid outlet member 66, and the spacer member 90 is fixed to the liquid outlet member 66.

The coupling member 85 preferably has rigidity to an extent where the spacer member 90 does not vibrate in the liquid storage portion 60*c* that contains liquid. In addition, the coupling member 85 more preferably has rigidity to an extent where the coupling member 85 does not plastically deform due to the weight of the bag 60 when the adapter 61 is held and the liquid container 20A is kept horizontally. Since the position of the spacer member 90 in the bag 60 is stabilized if such rigidity is secured, channels in the bag 60 are more unlikely to be blocked, and it is possible to more effectively suppress unevenness of the concentration of liquid that is supplied to the liquid ejection apparatus 11. In addition, by fixing the spacer member 90 to the liquid outlet member 66 via the bar-like coupling member 85, it is possible to further stabilize the positional relationship between the spacer member 90 and the liquid outlet member 66. Thus, it is possible to more effectively reduce a possibility that the concentration of liquid that is supplied to the liquid ejection apparatus 11 changes, in accordance with the individual liquid container 20A.

Note that, in another embodiment, the spacer member 90 is not required to be fixed to the liquid outlet member 66 via the coupling member 85. For example, a configuration may be adopted in which the spacer member 90 is fixed to an inner face of the bag 60, such that the position in which the spacer member 90 is arranged in the liquid storage portion 60*c* does not deviate.

In this embodiment, the lengths of the first conduit portion 81 and the second conduit portion 82 are substantially the same. In addition, the inner diameters of the first conduit portion 81 and the second conduit portion 82 are the same, and the outer diameters of these conduit portions are also the same. Therefore, it is possible to share a member of the first conduit portion 81 and the second conduit portion 82. In addition, it is possible to share a member of the first conduit portion 81 and the second conduit portion 82, and thus it is possible to prevent miss-attachment of the first conduit portion 81 and the second conduit portion 82. Note that, in another embodiments, the lengths, inner diameters, and outer diameters of the first conduit portion 81 and the second conduit portion 82 may be different.

Figure 15:
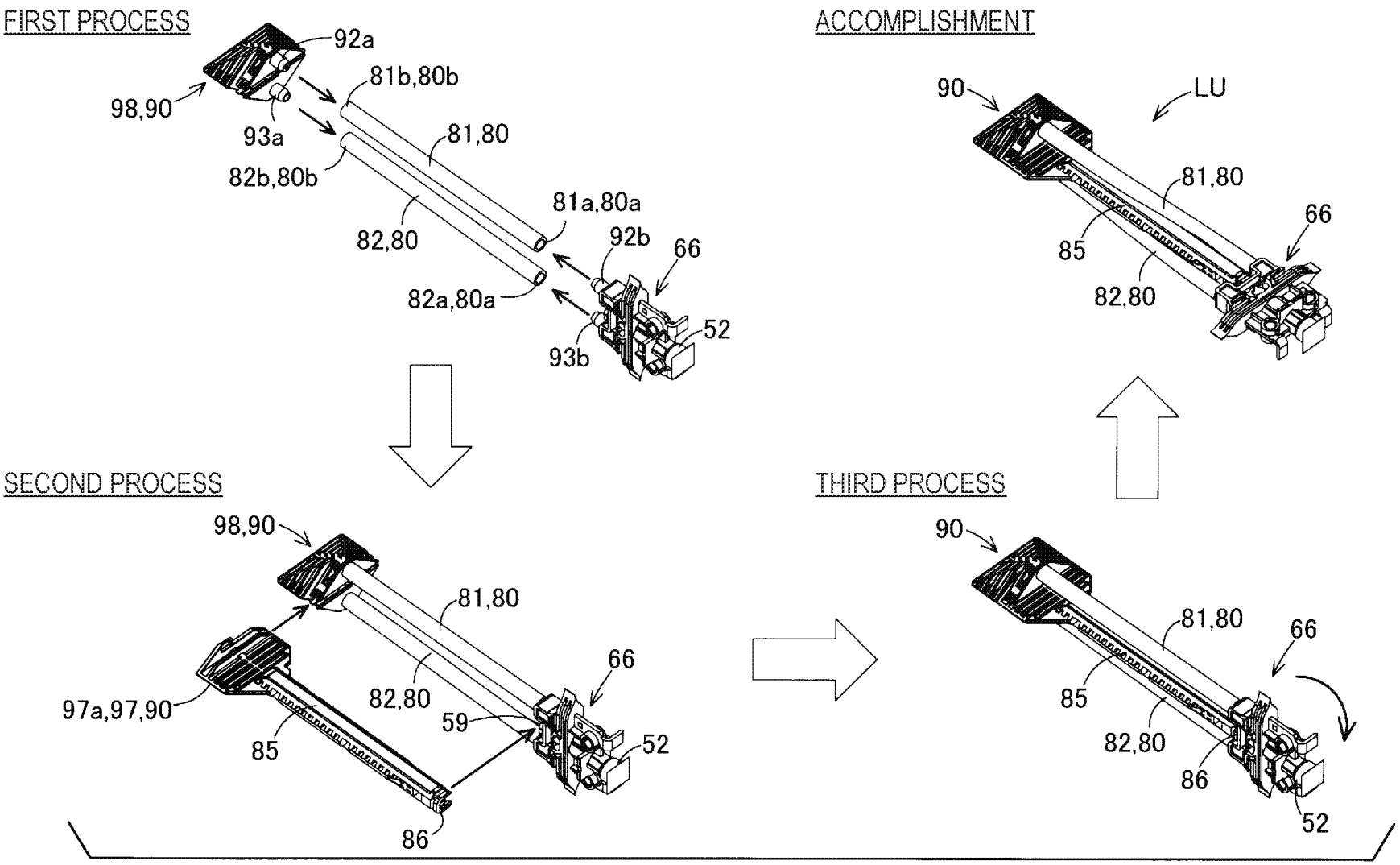
FIG. 15 is an explanatory view showing a method for assembling the liquid outlet unit.

FIG. 15 is an explanatory view showing how to assemble the liquid outlet unit LU. In a first process, the first conduit portion 81 and the second conduit portion 82 that constitute the liquid outlet tube 80 are aligned in parallel, and the liquid outlet member 66 and the front member 98 of the spacer member 90 are attached at the two ends of the liquid outlet tube 80. In a second process, the coupling member 85 with which the first section 97*a* of the partition portion 97 is integrated is prepared, and is inserted between the first conduit portion 81 and the second conduit portion 82. The first section 97*a* of the partition portion 97 is then slid toward and fixed to a slide fixing mechanism provided in the back face portion 94 of the front member 98, and the engagement portion 86 provided in the end portion of the coupling member 85 is fitted into the connection portion 59 of the liquid outlet member 66.

In a third process, the liquid outlet member 66 is rotated along with the first conduit portion 81 and the second conduit portion 82 by 90 degrees about the connection portion 59 relative to the spacer member 90 and the coupling member 85 coupled to each other. Accordingly, the connection portion 59 of the liquid outlet member 66 is fixed to the engagement portion 86 of the coupling member 85, and the first conduit portion 81 and the second conduit portion 82 are arranged to be twisted about the coupling member 85 along the coupling member 85. The liquid outlet unit LU is accomplished through the above processes. All of these processes can be automated using a robot.

A process for inserting the liquid outlet unit LU into the bag 60 will be described with reference to FIG. 9. The liquid outlet unit LU is inserted into the liquid storage portion 60*c* from the spacer member 90 side through the opening portion 60*d* provided in the one edge portion 60*a* of the bag 60, along the D direction. In this embodiment, the spacer member 90 has a shape pointed toward the +D direction side, and thus the liquid outlet unit LU can be smoothly inserted into the bag 60. In addition, in the liquid outlet unit LU, the maximum dimension of the outer periphery about the D direction in the spacer member 90 is smaller than the maximum dimension of the outer periphery about the D direction in a section that is welded to the opening portion 60*d*, in the liquid outlet member 66, and is smaller than the dimension of the inner periphery of the opening portion 60*d*. Thus, in the process for inserting the liquid outlet unit LU into the bag 60, damage due to the bag 60 coming into excessive contact with the spacer member 90 is suppressed.

Figure 16:
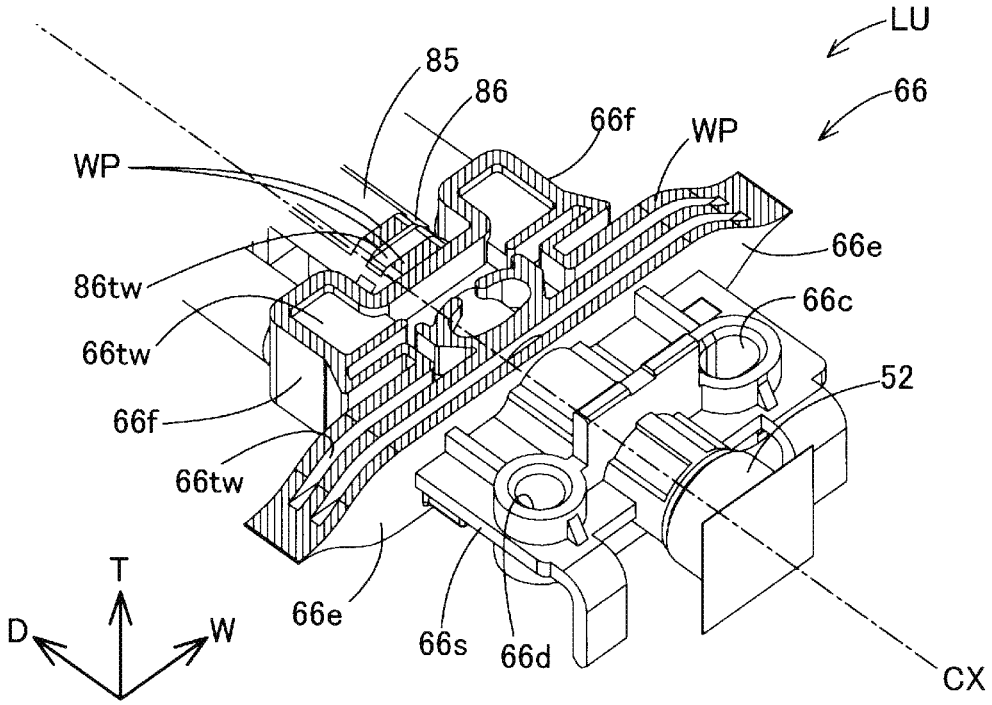
FIG. 16 is a schematic view showing a welding portion of a liquid outlet member.

FIG. 16 is a schematic perspective view showing a welded portion WP of the liquid outlet unit LU. FIG. 16 illustrates the end portion on the liquid outlet member 66 side of the liquid outlet unit LU. In FIG. 16, the welded portion WP that is welded to the bag 60 is hatched by oblique lines. The liquid outlet member 66 has an overhang portion 66*e* overhung from the central axis CX of the liquid outlet portion 52 in the +W direction and the −W direction, on the +D direction side of the fixing portion 66*s*. The overhang portion 66*e* is a section whose dimension in the W direction is largest in the liquid outlet member 66.

On the +D direction side of the overhang portion 66*e*, the liquid outlet member 66 has a pair of extension portions 66*f* extending in the +D direction to sandwich the engagement portion 86 of the coupling member 85 in the W direction. The extension portions 66*f* are substantially rectangular sections, and the third connection tube 92*b* and the fourth connection tube 93*b* (FIG. 12) are respectively provided in the end faces on the +D direction side of the extension portions 66*f*. In the liquid outlet unit LU, the first conduit portion 81 and the second conduit portion 82 are each fixed to corresponding one out of the pair of extension portions 66*f*.

Thin portions 66*tw* recessed locally in the T direction and thinned are provided in the overhang portion 66*e* and the extension portions 66*f* in order to decrease the weight of the liquid outlet member 66. In addition, a groove-like thin portion 86*tw* that is recessed in the −T direction, and extends in the W direction is formed in the face on the +T direction side of the engagement portion 86 in the coupling member 85 in order to decrease the weight of the coupling member 85. In the liquid outlet unit LU, the welded portion WP that is welded to the bag 60 is formed in a section adjacent to those thin portions 66*tw* and 86*tw* such that decrease in strength due to the thin portions 66*tw* and 86*tw* being provided is compensated by the welded portion WP. Therefore, damage of the liquid outlet unit LU due to the decrease in weight is suppressed.

In particular, in this embodiment, the thin portion 86*tw* in the engagement portion 86 of the coupling member 85 is formed at a position enclosed by the welded portion WP of the extension portions 66*f* in the W direction, and enclosed by the welded portion WP of the engagement portion 86 in the D direction. In this manner, the thin portion 86*tw* of the engagement portion 86 is surrounded by the welded portion WP in the W direction and the D direction, the thin portion 86*tw* is strictly protected by the welded portion WP. Therefore, damage of the coupling member 85 being bent in the engagement portion 86 is effectively suppressed.

Figure 17:
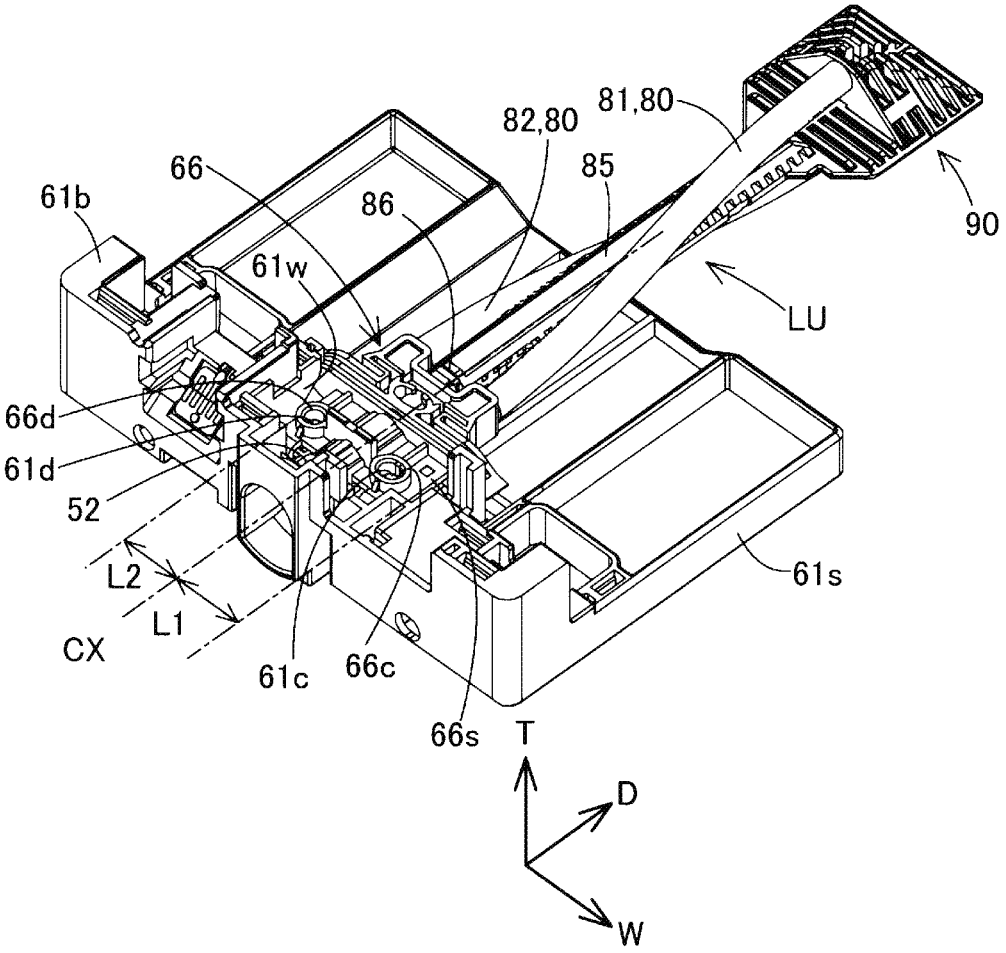
FIG. 17 is a schematic perspective view showing a state where the liquid outlet member is attached to a bottom member of an adapter.

A structure in which the bottom member 61*b* of the adapter 61 supports the bag unit 60*u* will be described with reference to FIGS. 7 and 17. FIG. 17 is a schematic perspective view showing a state where the liquid outlet member 66 is attached to the bottom member 61*b* of the adapter 61. In FIG. 17, as a matter of convenience, the bag 60 is not illustrated. In addition, FIG. 17 illustrates the central axis CX of the liquid outlet portion 52 in an alternate long and short dash line.

Below the internal structure IS, the bottom member 61*b* of the adapter 61 has an overhang support portion 61*s* extending on the +D direction side relative to a section in which the liquid outlet member 66 and the coupling member 85 are coupled and a section in which the liquid outlet member 66 and the liquid outlet tube 80 are connected. The overhang support portion 61*s* extends to substantially the same position as the end portion on the +D direction side of the grip portion 62*a* of the handle portion 62 in the D direction in the first orientation. The overhang support portion 61*s* extends to substantially the center in the D direction of the liquid outlet unit LU. In the liquid container 20A, detachment of the coupling member 85 from the liquid outlet member 66, detachment of the liquid outlet tube 80 from the liquid outlet member 66, and damage of the internal structure IS are suppressed by being supported by the overhang support portion 61*s* from below.

Description will be given with reference to FIG. 17. As described above, the first through hole 66*c* into which the first protrusion 61*c* is inserted and the second through hole 66*d* into which the second protrusion 61*d* is inserted are provided at positions sandwiching the liquid outlet portion 52 in the fixing portion 66*s* of the liquid outlet member 66. The first through hole 66*c* and the second through hole 66*d* are provided at substantially the same distance in opposite directions from the central axis CX of the liquid outlet portion 52, and are aligned in the W direction. The length of the fixing portion 66*s* from the central axis CX in the +W direction and the length of the fixing portion 66*s* in the −W direction are different. Specifically, a length L2 of the fixing portion 66*s* from the central axis CX in the −W direction, which is on the second protrusion 61*d* side, is shorter than a length L1 of the fixing portion 66*s* in the +W direction, which is on the first protrusion 61*c* side (L2<L1). In other words, the liquid outlet member 66 is formed to be asymmetrical relative to the central axis CX between the −W direction and the +W direction. In addition, a contact wall 61*w* is provided on the bottom member 61*b*, and is directed in the +T direction so as to be in contact with the end portion on the −W direction side of the fixing portion 66*s* on which the length of the fixing portion 66*s* is shorter. With such a configuration, the liquid outlet member 66 is prevented from being mounted to the bottom member 61*b* in a vertically inversed manner at the time of manufacturing the liquid container 20A. Note that the first through hole 66*c* provided in the fixing portion 66*s* is preferably a substantially elliptic shaped elongated hole longer in the W direction in order to prevent the liquid outlet member 66 from being disabled to be mounted to the bottom member 61*b* due to a manufacturing error.

As described above, according to the liquid container 20A of this embodiment, it is possible to suppress inhibition of flow of liquid in the bag 60. In addition, it is possible to keep liquid and sedimentary components from remaining in the liquid container 20A. Therefore, it is possible to sufficiently supply liquid to the liquid ejection apparatus 11. Moreover, it is possible to improve the evenness of the concentration of liquid that is supplied to the liquid ejection apparatus 11. Other than that, according to the liquid container 20A of this embodiment, it is possible to exert various actions and effects described in this embodiment.

2. Second Embodiment

Figure 18:
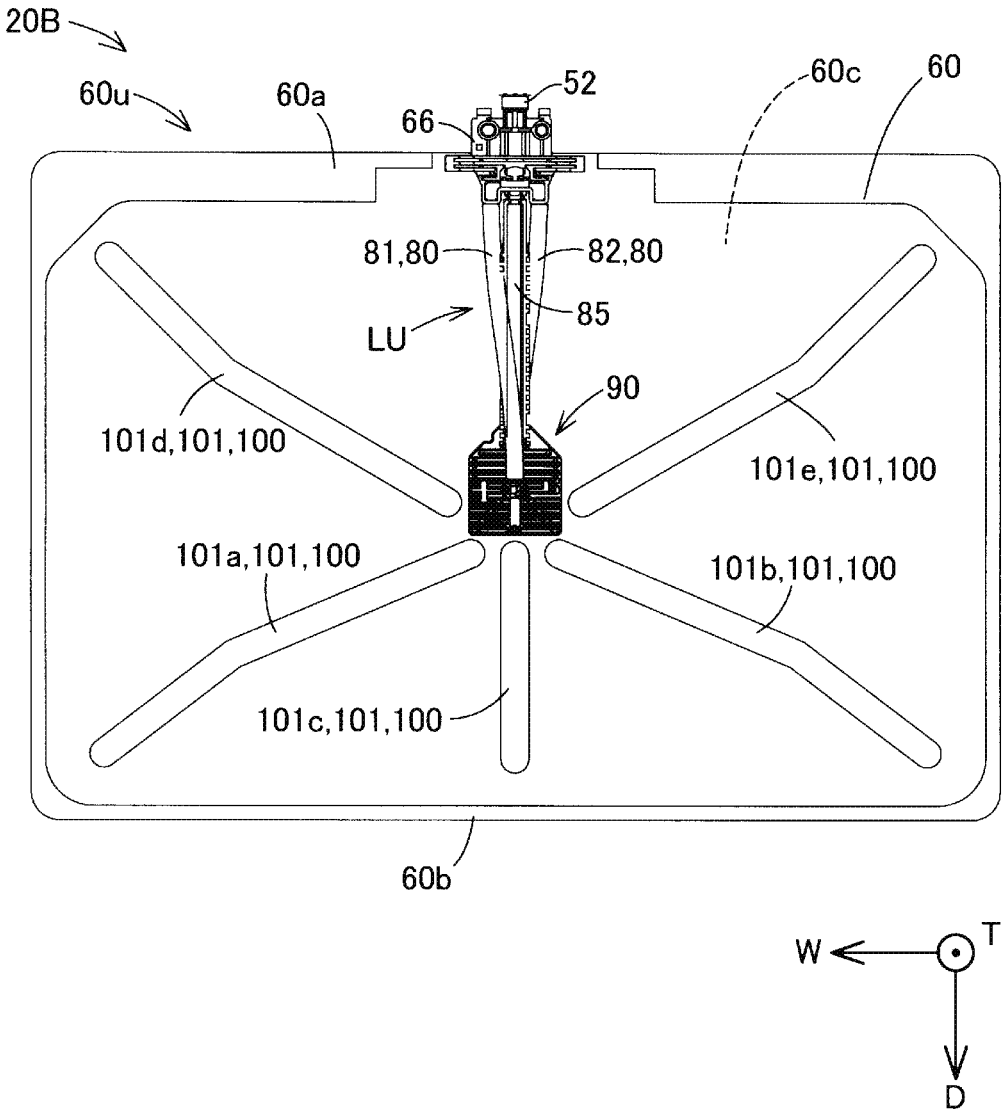
FIG. 18 is a schematic plane view showing the configuration of a channel of a liquid container in a second embodiment.

The configuration of directing channels 101 of a liquid container 20B in a second embodiment will be described with reference to FIG. 18. FIG. 18 is a schematic plane view of a bag unit 60*u* provided in the liquid container 20B of the second embodiment when viewed in the −T direction. In FIG. 18, as a matter of convenience, the entire liquid outlet unit LU is illustrated to be visible through the bag 60. The liquid container 20B of the second embodiment has substantially the same configuration as the configuration of the liquid container 20A of the first embodiment except that a third inclined channel 101*d* and a fourth inclined channel 101*e* are added as the directing channels 101 that are formed by a channel formation portion 100.

In the second embodiment, the channel formation portion 100 is configured to form five directing channels 101 extending from an end portion side of a liquid storage portion 60*c* in a direction approaching a spacer member 90. the five directing channels 101 include the third inclined channel 101*d* and the fourth inclined channel 101*e*, in addition to the first inclined channel 101*a*, the second inclined channel 101*b*, and the central channel 101*c* described in the first embodiment.

The third inclined channel 101*d* and the fourth inclined channel 101*e* extend from the −D direction side of the spacer member 90 in a direction approaching the spacer member 90. The third inclined channel 101*d* and the fourth inclined channel 101*e* (respectively) extend from the −D direction side of the spacer member 90 and one direction side out of the directions along the W direction, in a direction approaching the spacer member 90. The third inclined channel 101*d* and the fourth inclined channel 101*e* extend obliquely relative to the D direction.

The third inclined channel 101*d* extends from the −D direction side and the +W direction side of the spacer member 90 in a direction approaching the spacer member 90. The fourth inclined channel 101*e* extends from the −D direction side and the −W direction side of the spacer member 90 in a direction approaching the spacer member 90. The third inclined channel 101*d* and the fourth inclined channel 101*e* extend from the end portions in the W direction of the liquid storage portion 60*c* to the spacer member 90 arranged at the center in the W direction.

The end portions on the spacer member 90 side of the channels 101*d* and 101*e* are desirably positioned inside a region in the vicinity of a certain range from the spacer member 90, similar to the channels 101*a* to 101*c*. The end portions on the spacer member 90 side of the channels 101*d* and 101*e* are desirably positioned in a region in which a space remains in the periphery of the spacer member 90 when the liquid amount in the liquid storage portion 60*c* reaches a lower limit amount that has been set in the liquid ejection apparatus 11. The other edge portions of the channels 101*d* and 101*e* are desirably positioned at position closer to the end portion of the liquid storage portion 60*c* in a direction along the DW plane.

According to the liquid container 20B, the three directing channels 101*a* to 101*c* make it possible to suppress blockage of channels in regions on the +D direction side relative to the spacer member 90. In addition, liquid and sedimentary components are kept from remaining in these regions. Moreover, the third inclined channel 101*d* and the fourth inclined channel 101*e* make it possible to suppress blockage of channels in regions on the −D direction side of the spacer member 90. In addition, liquid and sedimentary components are kept from remaining in these regions. More specifically, the third inclined channel 101*d* makes it possible to suppress blockage of a channel in a region on the −D direction side and a region on the +W direction side relative to the spacer member 90. In addition, liquid and sedimentary components are kept from remaining in these regions. In addition, the fourth inclined channel 101*e* makes it possible to suppress blockage of a channel in a region on the −D direction side and a region on the −W direction side relative to the spacer member 90. In addition, liquid and sedimentary components are kept from remaining in these regions. Particularly, the third inclined channel 101*d* and the fourth inclined channel 101*e* extend from the corner of the liquid storage portion 60*c* on the −D direction side, and thus it is possible to keep liquid and sedimentary components from remaining in such a corner.

As described above, according to the liquid container 20B of the second embodiment, it is possible to suppress blockage of a channel in not only a region on the +D direction side relative to the spacer member 90 but also a region on the −D direction side relative to the spacer member 90. In addition, liquid and sedimentary components are kept from remaining in these regions. Other than that, according to the liquid container 20B of the second embodiment, various actions and effects described the above first embodiment can be exhibited in addition to various actions and effects described in the second embodiment.

3. Third Embodiment

Figure 19:
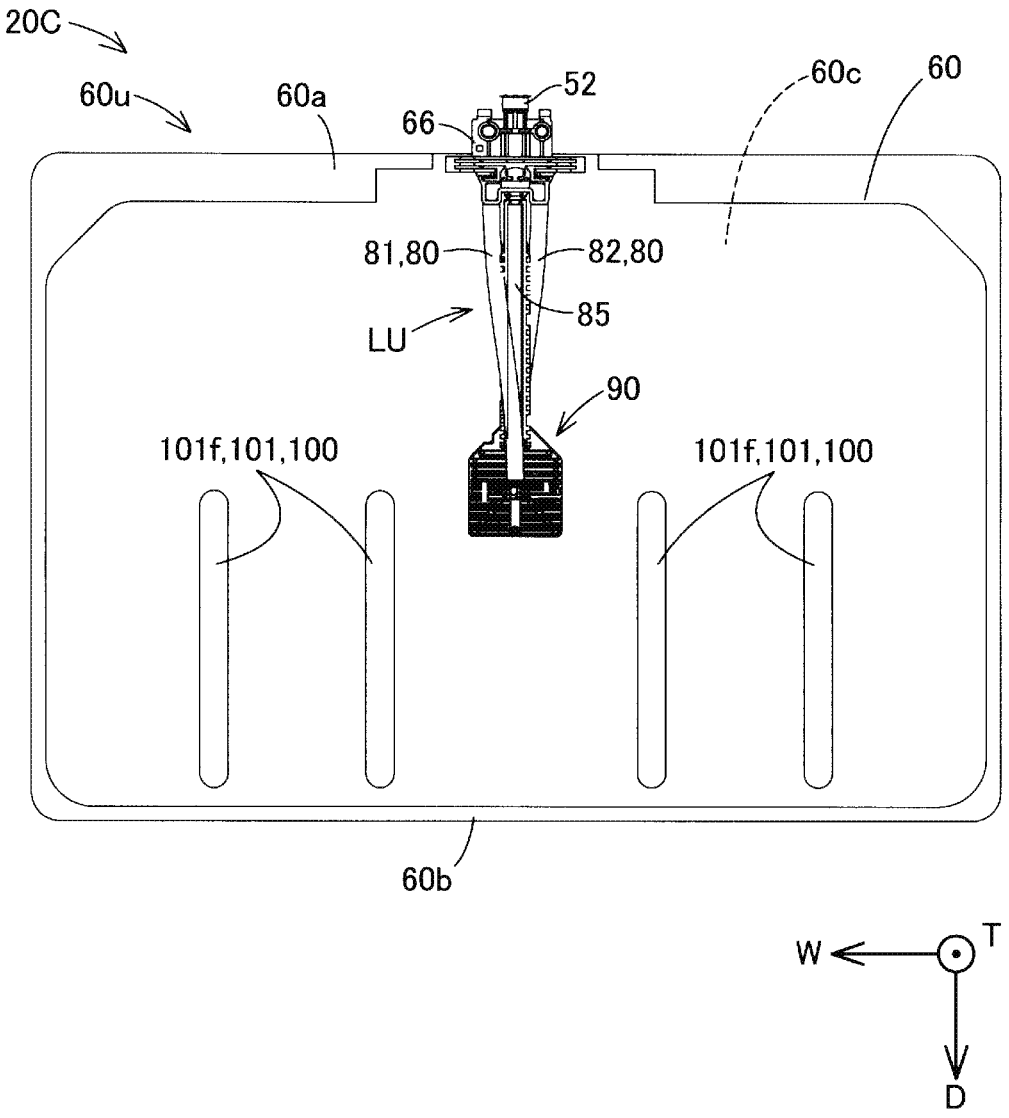
FIG. 19 is a schematic plane view showing the configuration of channels of a liquid container in a third embodiment.

The configuration of directing channels 101 of a liquid container 20C in a third embodiment will be described with reference to FIG. 19. FIG. 19 is a schematic plane view of a bag unit 60*u* provided in the liquid container 20C of the third embodiment when viewed in the −T direction. In FIG. 19, as a matter of convenience, the entire liquid outlet unit LU is illustrated to be visible through a bag 60. The liquid container 20C of the third embodiment has substantially the same as the configuration of the liquid container 20A of the first embodiment, except that a plurality of parallel channels 101*f* are formed as the directing channels 101 formed by the channel formation portion 100 in place of the three channels 101*a* to 101*c*.

In the third embodiment, the channel formation portion 100 is configured to form a plurality of parallel channels 101*f* as the directing channels 101 extending from end portion sides of the liquid storage portion 60*c* in a direction approaching the spacer member 90. In FIG. 19, a configuration is illustrated in which four parallel channels 101*d* are formed. Note that the number of channels 101*f* is not limited to four. Any number of channels 101*f*, namely two or more channels 101*f* may be formed.

The channels 101*f* extend, in the D direction, from the end portion side of the liquid storage portion 60*c* in a direction approaching the spacer member 90. The channels 101*f* extend from the +D direction side of the spacer member 90 in a direction approaching the spacer member 90. The channels 101*f* extend linearly along the D direction. Hereinafter, the channels 101*f* are also referred to as "longitudinal channels 101*f*". The longitudinal channels 101*f* are arranged in the W direction on the DW plane. The longitudinal channels 101*f* are desirably arranged evenly on the W direction on the DW plane. In the third embodiment, the longitudinal channels 101*f* include longitudinal channels 101*f* formed in a region on the +D direction side and the +W direction side relative to the spacer member 90 and longitudinal channels 101*f* formed in a region on the +D direction side and the −W direction side relative to the spacer member 90.

The end portions on the −D direction side of the longitudinal channels 101*f* are desirably positioned within a certain range relative to the position of the spacer member 90 in the D direction. The longitudinal channels 101*f* desirably extend to positions closer to the position of the spacer member 90 in the D direction. The other edge portions of the longitudinal channels 101*f* are desirably positioned at positions closer to the end portion on the +D direction side of the liquid storage portion 60*c* in a direction along the DW plane. In FIG. 19, the longitudinal channels 101*f* have the same length. However, the lengths of the longitudinal channels 101*f* may be different. The lengths of the longitudinal channels 101*f* may be determined appropriately.

According to the liquid container 20C of the third embodiment, a plurality of longitudinal parallel channels 101*f* make it possible to suppress blockage of channels in regions on the +D direction side relative to the spacer member 90. In addition, liquid and sedimentary components are kept from remaining in these regions. Longitudinal channels 101*f* positioned on the +W direction side relative to the spacer member 90 from among the plurality of longitudinal channels 101*f* make it possible to suppress blockage of channels in a region on the +D direction side and a region on the +W direction side relative to the spacer member 90. In addition, liquid and sedimentary components are kept from remaining in these regions. Longitudinal channels 101*f* positioned on the −W direction side relative to the spacer member 90 from among a plurality of longitudinal channels 101*f* make it possible to suppress blockage of channels in a region on the +D direction side and a region on the −W direction side relative to the spacer member 90. In addition, liquid and sedimentary components are kept from remaining in these regions. Other than that, according to the liquid container 20C of the third embodiment, it is possible to exert various actions and effects described in the above first embodiment in addition to various actions and effects described in the third embodiment.

4. Fourth Embodiment

Figure 20:
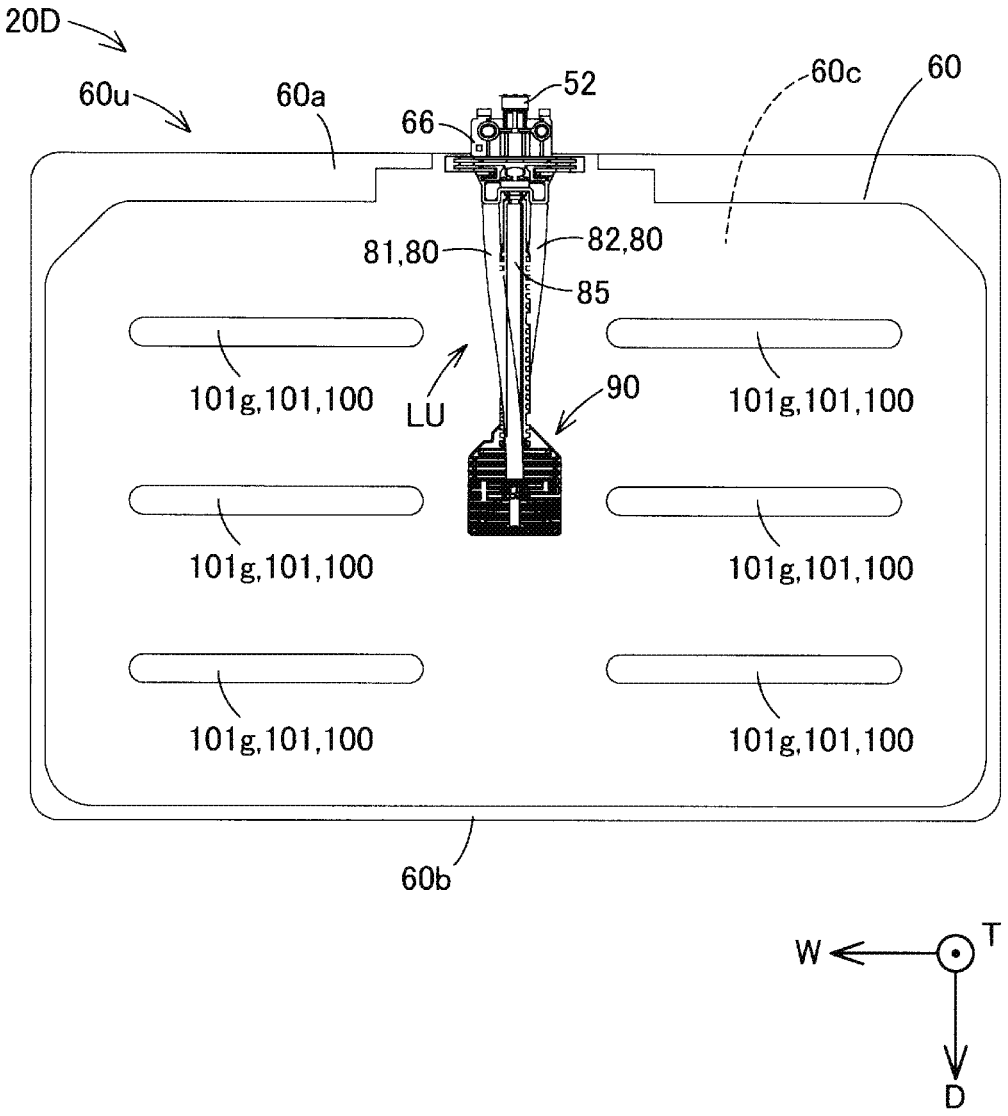
FIG. 20 is a schematic plane view showing the configuration of channels of a liquid container in a fourth embodiment.

The configuration of a directing channel 101 in a liquid container 20D in a fourth embodiment will be described with reference to FIG. 20. FIG. 20 is a schematic plane view of a bag unit 60*u* provided in the liquid container 20D of the fourth embodiment when viewed in the −T direction. As a matter of convenience, FIG. 20 illustrates the entire liquid outlet unit LU to be visible through the bag 60. The liquid container 20D of the fourth embodiment has substantially the same configuration as the configuration of the liquid container 20A of the first embodiment, except that channels 101*g* are formed as the directing channels 101 formed by the channel formation portion 100 in place of the three channels 101*a* to 101*c*.

In the fourth embodiment, a channel formation portion 100 is configured to form a plurality of channels 101*g*, as the directing channels 101 extending from end portion sides of the liquid storage portion 60*c* in directions approaching the spacer member 90. FIG. 20 illustrates a configuration in which six channels 101*g* are formed. Note that the number of channels 101*g* is not limited to six. In another embodiment, any number of channels 101*g*, namely one or more channels 101*g* may be formed.

The channels 101*g* extend, in the W direction, from the end portion sides in the W direction of the liquid storage portion 60*c* in a direction approaching the spacer member 90. The channels 101*g* extend from the +W direction side or the −W direction side of the spacer member 90 in a direction approaching the spacer member 90. The channels 101*g* extend linearly along the W direction. Hereinafter, the channels 101*g* are also referred to as "lateral channels 101*g*".

The lateral channels 101*g* include lateral channels 101*g* arranged in the D direction on the +W direction side relative to the spacer member 90 and lateral channels 101*g* arranged in the D direction on the −W direction side relative to the spacer member 90. Also in a region on the +W direction side of the spacer member 90 and a region on the −W direction side, the lateral channels 101*g* are desirably arranged evenly in the D direction.

The end portions on the spacer member 90 side of the lateral channels 101*g* are desirably positioned within a certain range relative to the position of the spacer member 90. The lateral channels 101*g* desirably extend to positions closer to the position of the spacer member 90 in the W direction. The other edge portions of the channels 101*f* are desirably positioned at positions closer to the end portion in the W direction of the liquid storage portion 60*c*, in a direction along the DW plane.

In the fourth embodiment, the lengths of the lateral channels 101*g* are the same. In addition, the number of lateral channels 101*g* in a region on the +W direction side relative to the spacer member 90 and the number of lateral channels 101*g* in a region on the −W direction side are the same. In addition, between those two regions, arrangement intervals in the D direction of the lateral channels 101*g* are equal, and arrangement positions in the D direction of the lateral channels 101*g* are aligned. In the fourth embodiment, the lateral channels 101*g* include a lateral channel 101*g* positioned in a region on the +D direction side relative to the spacer member 90, a lateral channel 101*g* positioned in a region on the −D direction side relative to the spacer member 90, and a lateral channel 101*g* aligned with the spacer member 90 in the D direction.

In another embodiment, the number of lateral channels 101*g* on the −W direction side relative to the spacer member 90 and the number of lateral channels 101*g* on the +W direction side relative to the spacer member 90 may be different. In addition, arrangement intervals in the D direction of the lateral channels 101*g* may be different between a region on the +W direction side relative to the spacer member 90 and a region on the −W direction side, and arrangement position in the D direction of the lateral channels 101*g* may be deviated. The lateral channels 101*g* on the −W direction side relative to the spacer member 90 or the lateral channels 101*g* on the +W direction side relative to the spacer member 90 may be omitted.

According to the liquid container 20D of the fourth embodiment, the lateral channels 101*g* make it possible to suppress blockage of channels in regions positioned on the W direction side relative to the spacer member 90. In addition, liquid and sedimentary components are kept from remaining in these regions. Lateral channels 101*g* positioned in a region on the +W direction side relative to the spacer member 90 from among a plurality of lateral channels 101*g* make it possible to suppress blockage of channels in regions on the +W direction side relative to the spacer member 90. In addition, liquid and sedimentary components are kept from remaining in these regions. Lateral channels 101*g* positioned in a region on the −W direction side relative to the spacer member 90 from among a plurality of lateral channels 101*g* make it possible to suppress blockage of a channel in a region on the −W direction side relative to the spacer member 90. In addition, liquid and sedimentary components are kept from remaining in these regions. Other than that, according to the liquid container 20D of the fourth embodiment, it is possible to exert various actions and effects described in the above first embodiment in addition to various actions and effects described in the fourth embodiment.

5. Other Embodiments

Various configurations described in the above embodiments can be modified as follows, for example. Embodiments to be described below are all regarded as examples of modes for implementing the invention, in the same manner as configurations described in the above embodiments and configurations described as other embodiments in the above embodiments.

5-1. Other Embodiment 1

The configuration of the directing channels 101 formed by the channel formation portion 100 is not limited to the configurations of the channels 101*a* to 101*g* described in the above embodiments. The channel formation portion 100 may be configured to form the following directing channels 101.

(1) In the above embodiments, a plurality of directing channels 101 are formed by the channel formation portion 100. Conversely, the channel formation portion 100 may be configured to form only one directing channel 101. For example, only one of the channels 101*a*, 101*b*, and 101*c* described in the first embodiment may be formed, or only one of the channels 101*d* and 101*e* described in the second embodiment may be formed. In addition, only one longitudinal channel 101*f* described in the third embodiment and only one lateral channel 101*g* described in the fourth embodiment may be formed.

(2) In the above embodiments, some of the channels 101*a* to 101*g* may be omitted. For example, the central channel 101*c* may be omitted from the configuration of the first embodiment, or at least one of the first inclined channel 101*a* and the second inclined channel 101*b* may be omitted. At least one of the first inclined channel 101*a*, the second inclined channel 101*b*, and the central channel 101*c* may be omitted from the configuration of the second embodiment, and at least one of the third inclined channel 101*d* and the fourth inclined channel 101*e* may be omitted.

(3) In the above third embodiment, the longitudinal channels 101*f* may be provided in a region on the −D direction side of the spacer member 90. In addition, in the above fourth embodiment, the lateral channels 101*g* may be provided in a region on the −D direction side relative to the spacer member 90.

(4) The channels 101*a* to 101*g* described in the above embodiments may be combined as appropriate. For example, the longitudinal channels 101*f* described in the fourth embodiment and the lateral channels 101*g* described in the fifth embodiment may be applied to the configurations of the first embodiment and the second embodiment. The lateral channels 101*g* described in the fourth embodiment may be added to the longitudinal channels 101*f* of the third embodiment.

(5) The directing channels 101 may be formed by the channel formation portion 100 in a mode including at least one of the following configurations. Note that the configurations of the channels 101*a* to 101*g* described in the above embodiments can be interpreted as being included in one of the following configurations <a>to <e>.

<a> Channel extending from the +D direction side of the spacer member 90 in a direction approaching the spacer member 90.

<b> Channel extending from the +D direction side and the +W direction side of the spacer member 90 in a direction approaching the spacer member 90.

<c> Channel extending from the +D direction side and the −W direction side of the spacer member 90 in a direction approaching the spacer member 90.

<d> Channel extending from the −D direction side and the +W direction side of the spacer member 90 in a direction approaching the spacer member 90.

<e> Channel extending from the −D direction side and the −W direction side of the spacer member 90 in a direction approaching the spacer member 90.

5-2. Other Embodiment 2

In the above embodiments, in the flexible bag 60, the channel formation portion 100 is constituted by a section formed into a shape inflated locally on the +T direction side. Conversely, the channel formation portion 100 may be configured to form the directing channels 101 by another method. For example, the channel formation portion 100 may be configured to form the directing channels 101 as grooves provided in the inner face of the bag 60. According to this configuration, even when liquid is consumed and the bag 60 collapses, spaces inside the grooves that constitutes the channel formation portion 100 remain as the directing channels 101 for directing liquid, and thus liquid and sedimentary materials are kept from remaining in a region separated from the spacer member 90. The channel formation portion 100 may be constituted by tubes that are arranged in the bag 60, and form the directing channels 101, for example. The tubes desirably have rigidity to an extent where the tube does not collapse along with the bag 60 when liquid is consumed and the bag 60 collapses. For example, the channel formation portion 100 may be constituted by a channel formation member (e.g., a columnar or thread-like member made of resin or metal) arranged along a section in which the directing channels 101 are formed in the bag 60. In this case, even if liquid is consumed to cause the bag 60 to collapse, and the inner face of the bag 60 and the channel formation member come into contact, it is possible to cause gaps generated in the periphery of the channel formation member to function as the directing channels 101. It is possible to interpret that the channel formation portion 100 is constituted by a structure for suppressing contact of inner faces opposed to each other in the T direction more than in other sections that constitute the liquid storage portion 60*c* of the bag 60, when liquid is consumed and the bag 60 is shrunk from a state where liquid of a prescribed amount or more is encapsulated.

5-3. Other Embodiment 3

In the liquid storage portion 60*c*, the section in which the spacer member 90 is arranged is not limited particularly. For example, in the liquid storage portion 60*c*, the spacer member 90 may be arranged at a position closer to the end portion on the −D direction side than the end portion on the +D direction side, or may be positioned at a position on the +W direction side or the −W direction side in the W direction. The shape of the spacer member 90 is not limited to the shape described in the above embodiments. The spacer member 90 is not required to have the inclined face 91 described in the above embodiments. In addition, it is not necessary to provide the first groove channels 95, the second groove channels 96, and the partition portion 97. The spacer member 90 may have a rectangular parallelepiped shape, for example, or may have another polyhedral shape. In addition, the spacer member 90 may have a spherical or hemispherical shape, or a shape acquired by combining a polyhedral shape and a spherical shape.

5-4. Other Embodiment 4

In the above embodiments, the coupling member 85 is not required to have a bar-like shape, and for example, may be constituted by a string-like member or a band-like member. In the above embodiments, the coupling member 85 may be omitted.

5-5. Other Embodiment 5

In the above embodiments, the first base end portion 81*a* and the second base end portion 82*a* of the liquid outlet tube 80 are not required to be aligned in the horizontal direction. The first base end portion 81*a* and the second base end portion 82*a* may be arranged obliquely relative to the horizontal direction, for example. In addition, the first leading end portion 81*b* and the second leading end portion 82*b* of the liquid outlet tube 80 are not required to be aligned in the vertical direction. The first leading end portion 81*b* and the second leading end portion 82*b* may be arranged obliquely relative to the vertical direction. The first leading end portion 81*b* and the second leading end portion 82*b* of the liquid outlet tube 80 may be arranged to be aligned in the horizontal direction.

5-6. Other Embodiment 6

In the above embodiments, the first leading end portion 81*b* and the second leading end portion 82*b* of the liquid outlet tube 80 are not required to be fixed to the spacer member 90. If the liquid outlet tube 80 is arranged to extend toward the spacer member 90, the first leading end portion 81*b* and the second leading end portion 82*b* of the liquid outlet tube 80 may be arranged at positions separated from the spacer member 90.

5-7. Other Embodiment 7

In the above embodiments, the mounted orientation of the liquid storage bodies 20A to 20D is an orientation in which the DW plane is horizontal. On the other hand, the mounted orientation of the liquid storage bodies 20A to 20D is not required to be an orientation in which the DW plane is horizontal. The mounted orientation of the liquid container 20A to 20D may be an orientation in which the D direction is a direction along the vertical direction such that the −D direction is an upward direction and the +D direction is a downward direction, for example.

5-8. Other Embodiment 8

The invention is not limited to an inkjet printer and a liquid container for supplying ink to the inkjet printer, and can also be applied to any liquid ejection apparatus for ejecting a liquid other than ink and a liquid container used for such a liquid ejection apparatus. For example, the invention can be applied to the following various liquid ejection apparatuses and liquid storage bodies for such liquid ejection apparatuses.

(1) an image recording apparatus such as a facsimile apparatus, (2) a color material ejection apparatus used for manufacturing a color filter for an image display device such as a liquid crystal display, (3) an electrode material ejection apparatus used for forming an electrode of an organic EL (Electro Luminescence) display, a surface light emission display (Field Emission Display, FED) or the like, (4) a liquid ejection apparatus for ejecting a liquid containing a biological organic substance used for manufacturing a biochip, (5) a sample ejection apparatus as a precision pipette, (6) a lubricant oil ejection apparatus, (7) a resin liquid ejection apparatus, (8) a liquid ejection apparatus for ejecting lubricant oil onto a precision device such as a timepiece and a camera in a pin-point manner, (9) a liquid ejection apparatus for ejecting transparent resin liquid such as ultraviolet-curing resin liquid onto a substrate in order to form a microhemispherical lens (an optical lens) or the like used in an optical communication element or the like,

(10) a liquid ejection apparatus for ejecting acidic or alkaline etching liquid in order to etch a substrate or the like, and

(11) a liquid ejection apparatus provided with a liquid consumption head for discharging a very small amount of droplet of any other liquid Note that a "droplet" refers to a state of liquid discharged from a liquid ejection apparatus, and includes a granular shape, a tear-drop shape, and a shape having a thread-like trailing end. In addition, the "liquid" mentioned here may be any kind of material that can be consumed by the liquid ejection apparatus. For example, the "liquid" need only to be a material whose substance is in the liquid phase, and includes fluids such as an inorganic solvent, an organic solvent, a solution, a liquid resin, and a liquid metal (metal melt) in the form of a material in the state of liquid having a high or low viscosity, a sol, gel water, or the like. In addition, the "liquid" is not limited to being a one-state substance, and also includes particles of a functional material made from solid matter, such as pigment or metal particles, that are dissolved, dispersed, or mixed in a solvent. Representative examples of the liquid include ink such as that described in the above embodiments, liquid crystal, or the like. Here, "ink" encompasses general water-based ink and oil-based ink, as well as various types of liquid compositions such as gel ink and hot melt-ink.

The invention is not limited to the above embodiments and modified example and can be achieved as various configurations without departing from the gist of the invention. For example, the technical features in the embodiments and the modified example that correspond to the technical features in the modes described in the summary of the invention may be replaced or combined as appropriate in order to solve a part of, or the entire foregoing problem, or to achieve some or all of the above-described effects. The technical features that are not described as essential in the specification may be deleted as appropriate.

The present application is based on, and claims priority from JP Application Serial Number 2017-242667, filed Dec. 19, 2017, the disclosure of which is hereby incorporated by reference herein in its entirety.

What is claimed is:

1. A liquid container for supplying a liquid containing a sedimentary component to a liquid ejection apparatus, the liquid container comprising:

a flexible bag in which a liquid storage portion for containing the liquid is provided, and that has one edge portion and another edge portion opposing the one edge portion;

a liquid outlet member that is attached to the one edge portion, and has a liquid outlet portion for leading out the liquid in the liquid storage portion to the liquid ejection apparatus;

a spacer member arranged in the liquid storage portion; and a liquid outlet tube that constitutes a flow path of the liquid that extends in the liquid storage portion from the liquid outlet member toward the spacer member, wherein when three directions orthogonal to each other are defined as a D direction, a T direction, and a W direction, the D direction being defined as a direction along a direction from the one edge portion side of the bag toward the other edge portion side, where a direction from the one edge portion side toward the other edge portion side is defined as a +D direction and an opposite direction to the +D direction is defined as a −D direction, and the T direction being defined as a direction in which a dimension of an outer shape of the liquid container is smallest among the three directions, the spacer member is arranged at a position separated from edge portions of the liquid storage portion in the W direction and in the D direction, and at least one directing channel that extends along a DW plane that includes the D direction and the W direction, from an edge portion side of the liquid storage portion in a direction approaching the spacer member, and directs the liquid toward the spacer member is formed in the liquid storage portion.

2. The liquid container according to claim 1, wherein the at least one directing channel includes a channel extending from the +D direction side of the spacer member in a direction approaching the spacer member.

3. The liquid container according to claim 2, wherein the at least one directing channel includes a channel extending from the +D direction side of the spacer member and one direction side out of directions along the W direction, in a direction approaching the spacer member.

4. The liquid container according to claim 1, wherein the at least one directing channel includes a channel extending from the −D direction side of the spacer member and one direction side out of directions along the W direction, in a direction approaching the spacer member.

5. The liquid container according to claim 1, wherein when one direction in the W direction is defined as a +W direction, and a direction opposite to the +W direction is defined as a −W direction, the at least one directing channel includes:

a first inclined channel extending from the +D direction side and the +W direction side of the spacer member in a direction approaching the spacer member, and a second inclined channel extending from the +D direction side and the −W direction side of the spacer member in a direction approaching the spacer member.

6. The liquid container according to claim 5, wherein the at least one directing channel further includes a central channel that is positioned between the first inclined channel and the second inclined channel in the W direction, and extends from the +D direction side of the spacer member in a direction approaching the spacer member.

7. The liquid container according to claim 5, wherein the at least one directing channel further includes:

a third inclined channel extending from the −D direction side and the +W direction side of the spacer member in a direction approaching the spacer member, and a fourth inclined channel extending from the −D direction side and the −W direction side of the spacer member in a direction approaching the spacer member.

8. The liquid container according to claim 1, wherein the spacer member has an inclined face that is inclined relative to the D direction such that a dimension along the T direction increases toward the −D direction side from the +D direction side.

9. The liquid container according to claim 1, wherein the liquid outlet tube is configured to, in an orientation in which the liquid container is mounted in the liquid ejection apparatus, extend from the liquid outlet portion in the liquid storage portion in a horizontal direction, the liquid outlet tube has a first conduit portion and a second conduit portion, the first conduit portion has a first base end portion that is connected to the liquid outlet member and a first leading end portion for introducing the liquid in the liquid storage portion into the first tube portion, the second conduit portion has a second base end portion that is connected to the liquid outlet member and a second leading end portion for introducing the liquid in the liquid storage portion into the second conduit portion, and in the orientation, the first leading end portion is positioned above the second leading end portion.

10. The liquid container according to claim 9, wherein the first leading end portion and the second leading end portion are connected to the spacer member.

11. The liquid container according to claim 10, wherein, in the orientation, the first base end portion and the second base end portion are aligned in a horizontal direction, and the first leading end portion and the second leading end portion are aligned in a vertical direction.

12. The liquid container according to claim 9, wherein the spacer member is fixed to the liquid outlet member.

13. The liquid container according to claim 12, wherein the spacer member is fixed to the liquid outlet member via a bar-like coupling member.

* * * * *